United States Patent [19]

Conner, Jr.

[11] 4,181,085

[45] Jan. 1, 1980

[54] AUTOMATIC SEWING APPARATUS

[75] Inventor: William R. Conner, Jr., Shelbyville, Tenn.

[73] Assignee: Stahl-Urban Company, Brookhaven, Mo.

[21] Appl. No.: 824,341

[22] Filed: Aug. 15, 1977

[51] Int. Cl.[2] ..... D05B 21/00; D05B 27/06

[52] U.S. Cl. ..... 112/121.12; 112/308; 112/153

[58] Field of Search ..... 112/204, 205, 203, 121.12, 112/121.29, 153; 271/1, 225, 121.15

[56] References Cited

U.S. PATENT DOCUMENTS

| | | | |
|---|---|---|---|
| 3,204,591 | 9/1965 | Pickett | 112/121.11 |
| 3,769,924 | 11/1973 | Rogers et al. | 112/121.29 |
| 3,970,017 | 7/1976 | Babson et al. | 112/153 X |
| 4,117,790 | 10/1978 | Hasegawa et al. | 112/205 |

FOREIGN PATENT DOCUMENTS

| | | | |
|---|---|---|---|
| 1567893 | 4/1969 | France | 112/205 |

*Primary Examiner*—Peter Nerbun
*Attorney, Agent, or Firm*—Koenig, Senniger, Powers and Leavitt

[57] ABSTRACT

Apparatus for automatically sewing workpieces along edges of each workpiece extending in different directions, in which a workpiece is automatically turned when it has been stitched along one edge for stitching it along the next edge, by blowing air on the workpiece to swing it around, using the needle of the sewing machine as a pivot, and in which workpieces are automatically entered in the sewing machine for being stitched and automatically removed after they have been stitched.

29 Claims, 25 Drawing Figures

AUTOMATIC SEWING APPARATUS

BACKGROUND OF THE INVENTION

This invention relates to automatic sewing apparatus, and more particularly to such apparatus for automatically sewing workpieces along edges of each workpiece extending in different directions.

The apparatus of this invention has been developed particularly for topstitching shirt collars, involving stitching component layers of a collar together first along one end edge of the collar, then along the lower edge of the collar, and finally along the other end edge of the collar. It is to be understood, of course, that the apparatus is useful for stitching other workpieces, such as shirt cuffs, pants pockets, etc. With suitable guidance of collars, it may be useful for runstitching them.

SUMMARY OF THE INVENTION

Among the several objects of the invention may be noted the provision of improved automatic sewing apparatus of the class described adapted for high-speed operation for increased production, without requiring a highly skilled operator; the provision of such apparatus which, while enabling high-speed production, is less complex and safer than prior apparatus in the same general field, and the output of which is of improved appearance at the edges, particularly in the case of shirt collars; and the provision of such apparatus in which workpieces are automatically entered in the sewing machine for being stitched, and automatically removed after having been stitched.

In general, apparatus of this invention comprises a sewing machine having means for feeding a workpiece therethrough for being stitched and a needle for stitching a seam along an edge of the workpiece as it is fed through the sewing machine; means for controlling the sewing machine operable to start it and operable to stop it with the needle down in a workpiece for utilization of the needle as a pivot for turning the workpiece; means for guiding a workpiece through the sewing machine for stitching a seam along an edge of the workpiece; means operable with the needle down in a workpiece for blowing air on the workpiece in such direction as to turn the workpiece by blowing it around the needle as a pivot; and means operable as a workpiece is being fed through the sewing machine and stitched along one edge thereof for sensing when the workpiece reaches a seam-ending position for terminating the stitching along said one edge and starting the stitching along the next edge. Means controlled by said sensing means is operable when said sensing means senses the workpiece reaching said seam-ending position for operating said sewing machine control means to stop the sewing machine with the workpiece in said seam-ending position and with the needle down in the workpiece, and then operating the blowing means to blow air on the workpiece for blowing it around. Stop means engageable by an edge of the workpiece as the workpiece is being blown around is provided to stop the workpiece in a seam-starting position for stitching a seam along the next edge; and means operable by the workpice as it reaches said seam-starting position is provided for controlling said sewing machine control means to start the sewing machine for stitching along said next edge.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 21, 22:
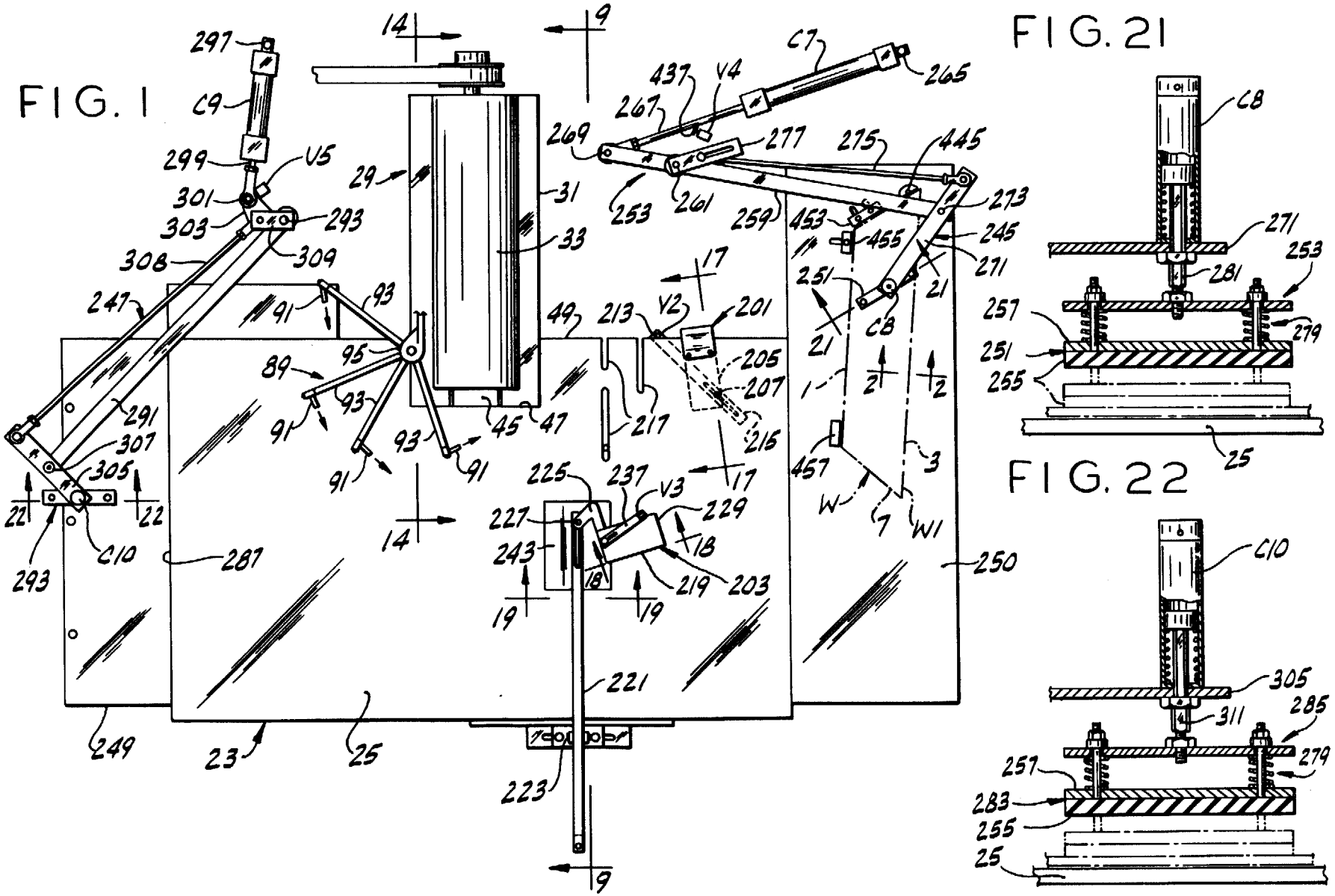
FIG. 1 is a general plan of an automatic sewing apparatus of this invention, showing a collar which has been runstitched and which is to be topstitched, in an initial position from which it is moved for entry in the sewing machine of the apparatus to start the topstitching operation.
FIGS. 21 and 22 are enlarged vertical sections generally on lines 21—21 and 22—22, respectively, of FIG. 1.

Referring to the drawings, there is illustrated automatic sewing apparatus of this invention for automatically sewing workpieces along edges of each workpiece extending in different directions, more particularly for topstitching shirt collar workpieces such as indicated at W. These shirt collar workpieces W generally have the shape of a relatively long and narrow isosceles trapezoid, having generally parallel upper and lower edges 1 and 3 and end edges 5 and 7. The upper edge 1 is the shorter of the two generally parallel edges 1 and 3. The end edges 5 and 7, which are generally straight, extend at an angle of about 50°, for example, to the lower edge 3. The lower edge 3 generally has a slight convex curvature, instead of being exactly straight. The upper edge 1 also generally has a slight convex curvature.

Figure 2:
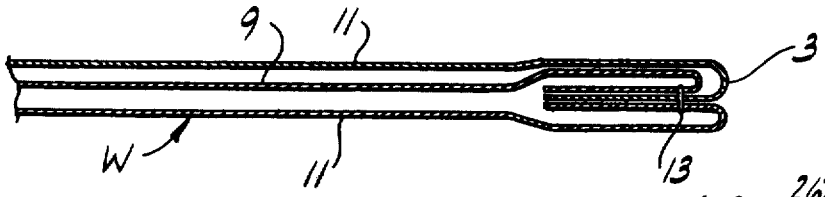
FIG. 2 is a section of the runstitched collar on line 2—2 of FIG. 1, showing its layers or plies.

The collar workpiece W generally comprises three layers or plies of material: an intermediate layer 9 of a relatively stiff material and outer layers each designated 11 of shirt fabric (see FIG. 2). It has generally been made by preliminarily assembling the two layers 11 and layer 9 with the layers 11 face-to-face and layer 9 on one of the layers 11, then stitching the three layers together around one end edge, the lower edge and the other end edge of the assembly, this stitching (referred to as "runstitching") being about one-fourth inch in from the edges, and then turning the outer of the layers 11 to lie on the opposite side of the layer 9 from the other layer 11. This sandwiches the stiff layer 9 between the layers 11, and turns in the runstitching, which is indicated at 13 in FIG. 2. The runstitching may be carried out by a machine such as shown in my U.S. Pat. No. 3,771,477, issued Nov. 13, 1973. The layer 9 imparts some degree of stiffness to the workpiece.

Figure 4:
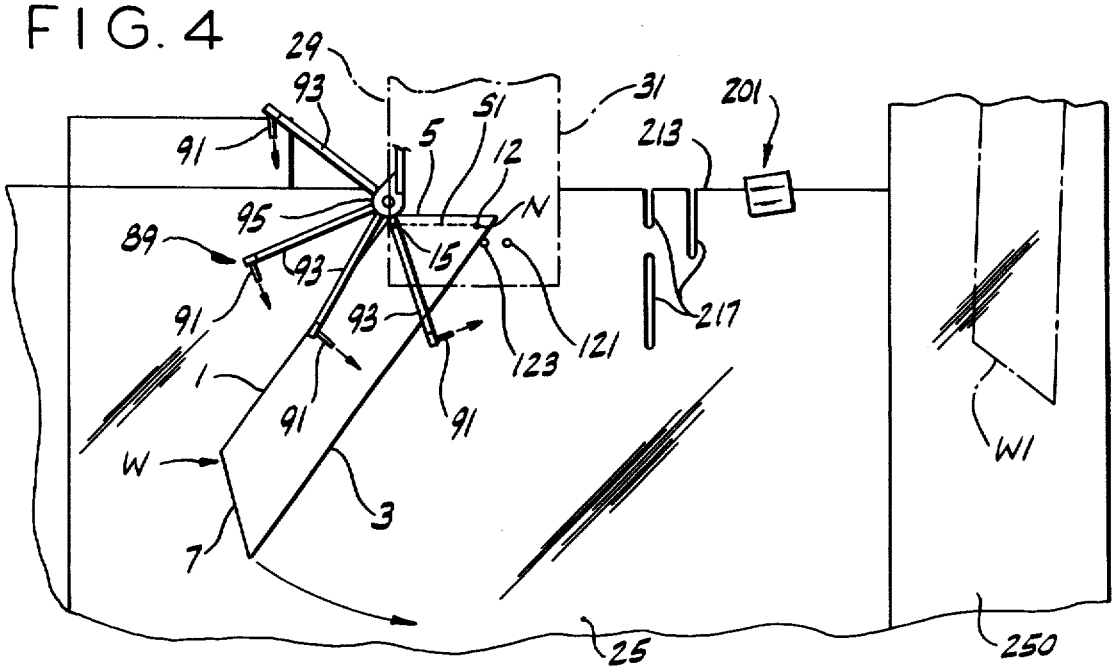
FIG. 4 is a view similar to FIG. 3 showing the collar at the end of the stitching of a seam along said one end edge.
Figure 6:
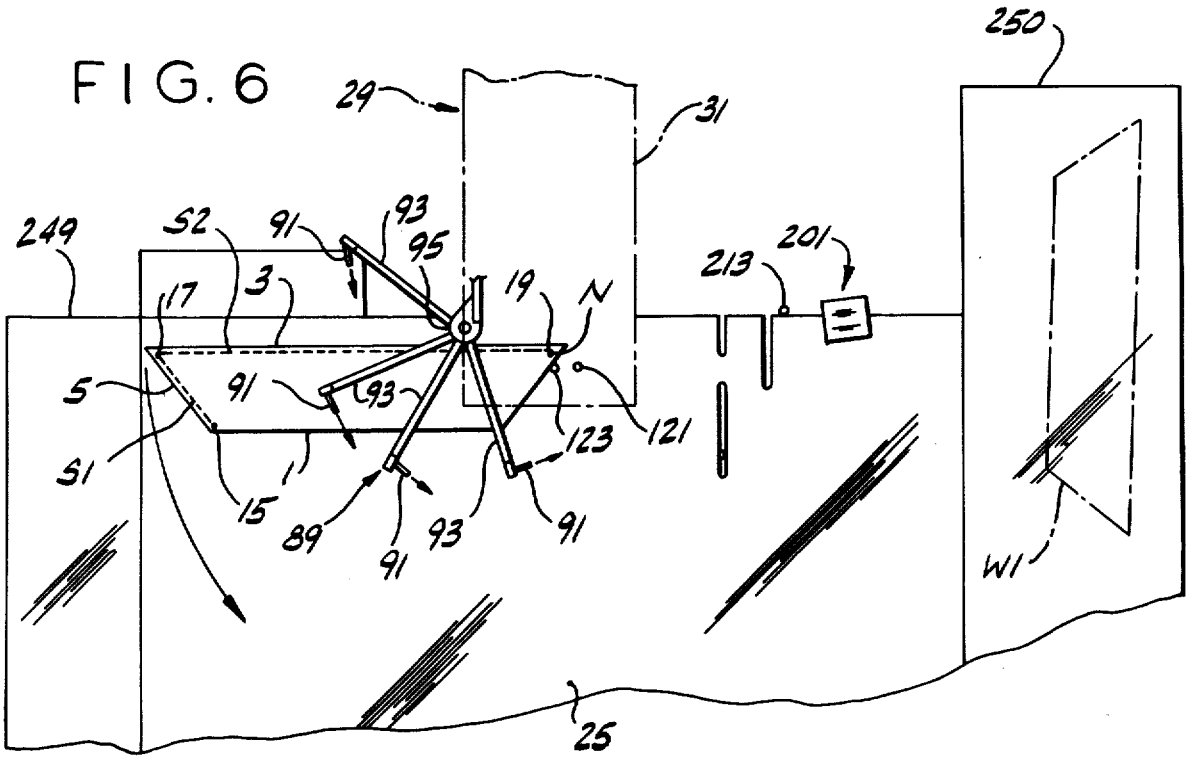
FIG. 6 is a view similar to FIG. 5 showing the collar at the end of the stitching of the seam along its lower edge.
Figure 7:
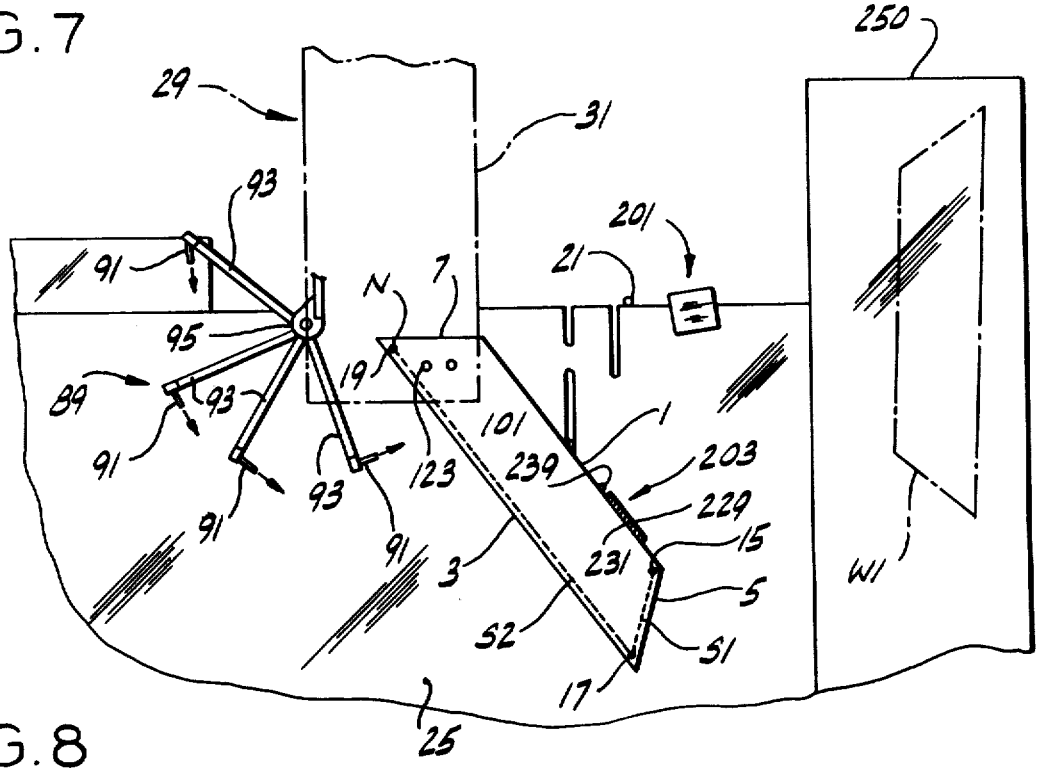
FIG. 7 is a view similar to FIG. 6 showing the collar swung around the needle as a pivot to start the sewing of a seam along the other end edge of the collar.
Figure 8:
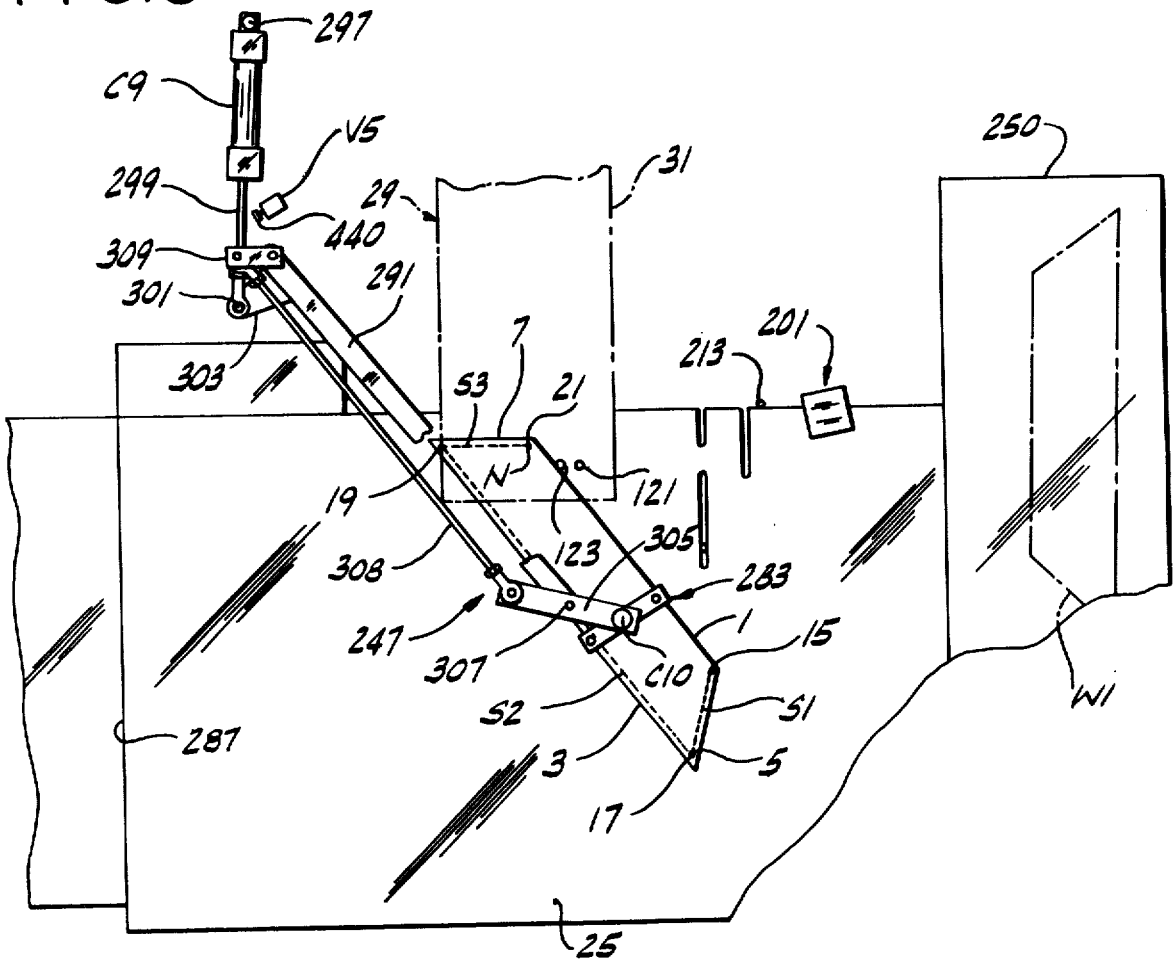
FIG. 8 is a view similar to FIG. 7 showing the collar at the end of the stitching of the seam along its said other end edge, thus completing the topstitching of the collar, and also showing an unloading means in position for unloading the topstitched collar.

The apparatus of this invention, as herein illustrated, is adapted to topstitch the runstitched collar workpieces W, meaning that it is adapted to stitch a seam S1 along end edge 5 extending from a point 15 adjacent the upper edge 1 of the workpiece to a point 17 adjacent the lower edge 3 (see FIG. 4), then to turn the workpiece (see FIG. 5) and stitch a second seam S2 along the lower edge 3 from point 17 to a point 19 adjacent the end edge 7 (see FIG. 6) and then to turn the workpiece (see FIG. 7) and stitch a third seam S3 along end edge 7 from point 19 to a point 21 adjacent the upper edge 1 (see FIG. 8). Seams S1, S2 and S3 may be spaced inwardly from their respective workpiece edges 5, 3 and 7 a distance of about one-fourth inch, for example, each generally paralleling its respective edge.

Figure 9:
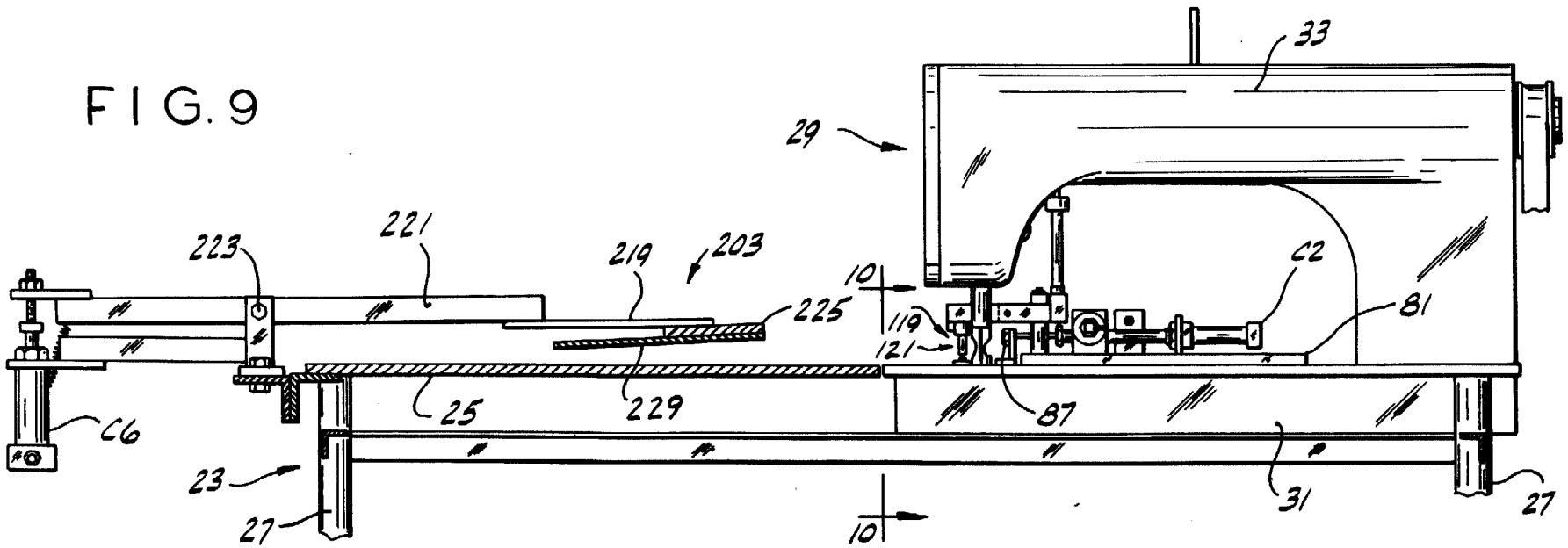
FIG. 9 is a vertical transverse section generally on line 9—9 of FIG. 1.

The apparatus comprises a table structure generally indicated at 23 including a table top plate 25 on suitable legs such as indicated at 27 in FIG. 9. The top plate 25 is relatively smooth for relatively easy sliding of the workpiece thereover, but not so smooth as relatively completely to eliminate drag on a workpiece as it slides thereon. At 29 is generally indicated a sewing machine mounted on the table structure, the bed of the machine being indicated at 31 and the overarm of the sewing machine being indicated at 33. The sewing machine includes means indicated generally at 35 in FIG. 12 for feeding a workpiece therethrough, a needle N for stitching a seam (e.g., S1, S2, S3) along an edge of a workpiece as it is fed through the machine, and a presser foot 37 for pressing a workpiece down against the throat plate 39 of the sewing machine for the feeding of the workpiece through the machine. The feeding means comprises feed dogs 41 which move up and then forward through a forward stroke to feed a workpiece in forward (or downsteam) direction (which is toward the left as viewed in FIGS. 1, 3–8 and 12) over the throat plate 39, and then move downward and back through a return stroke for the next feeding step. As will be readily understood, the needle N is up out of the workpiece on each forward stroke of the feed dogs to feed the workpiece forward, and comes down into the workpiece as the feed dogs move back through a return stroke during the attendant dwell of the workpiece.

Figure 12:
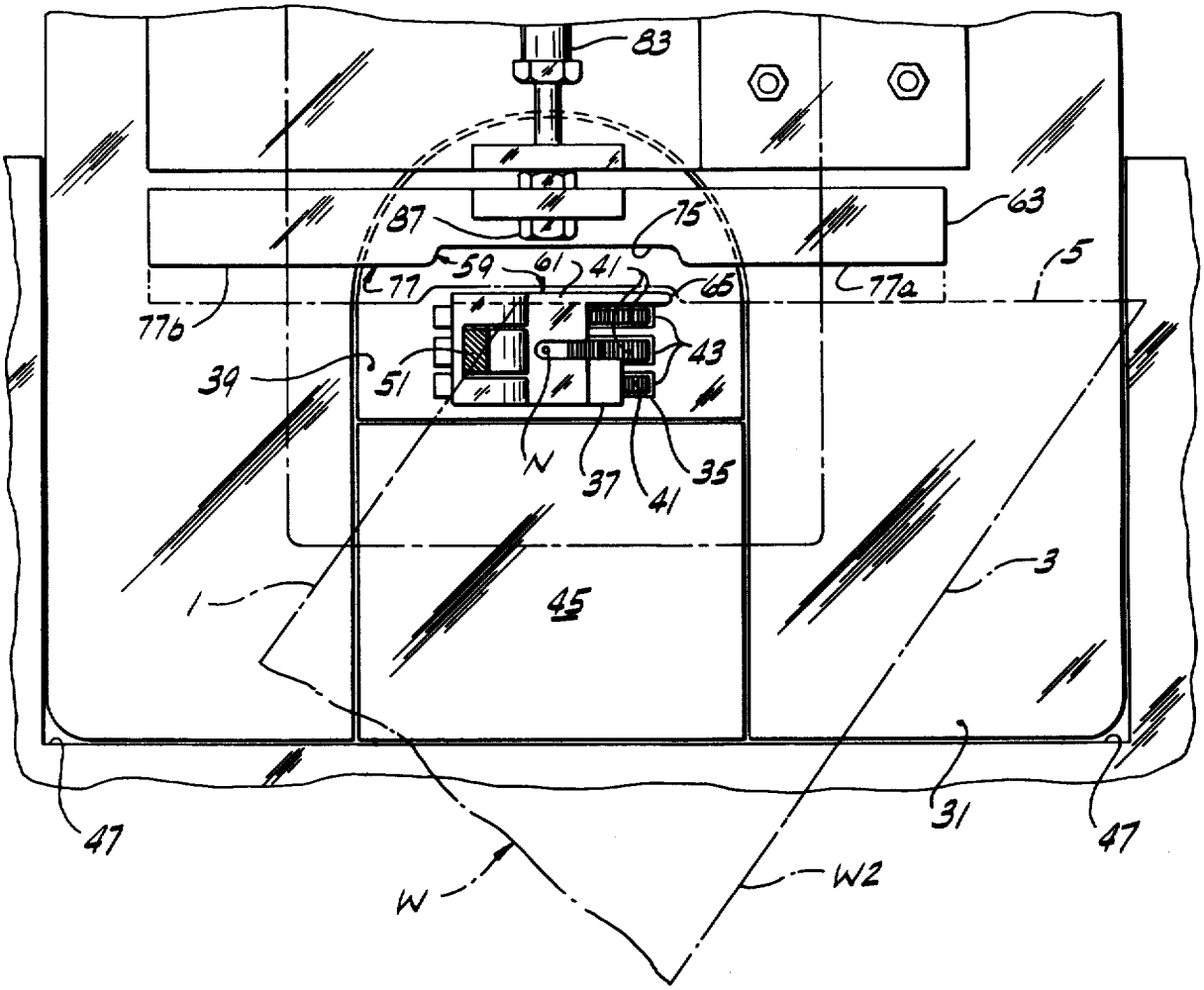
FIG. 12 is an enlarged fragment of FIG. 1, with parts broken away, showing the needle, the feed dogs, the presser foot of the sewing machine, and certain appurtenant mechanism.

The feed dogs 41 are adapted to move up and then forward through slots such as indicated at 43 in the throat plate 39 of the sewing machine (see FIG. 12). The machine has an inspection plate 45 flush with the throat plate and with the top of its bed 31 at the needle end of the machine. The machine is mounted on the table structure 23 with the end of the bed at the needle end of the machine in a cutout 47 in the table top plate 25 and with the top of the bed 31 (and the throat plate 39 and inspection plate 45) flush with the plate 25. The bed 31 extends into the cutout 47 a distance such that the needle N is located some distance inwardly from that edge of the plate 25 which is indicated at 49 in FIGS. 1 and 3 whereby the sewing path extends generally parallel to edge 49 some distance (about 1¼", for example) inwardly from said edge. The presser foot 37 is secured on the lower end of rod 51 which is vertically movable by an air cylinder C1 (see FIG. 14), for raising and lowering the presser foot.

Figure 13:
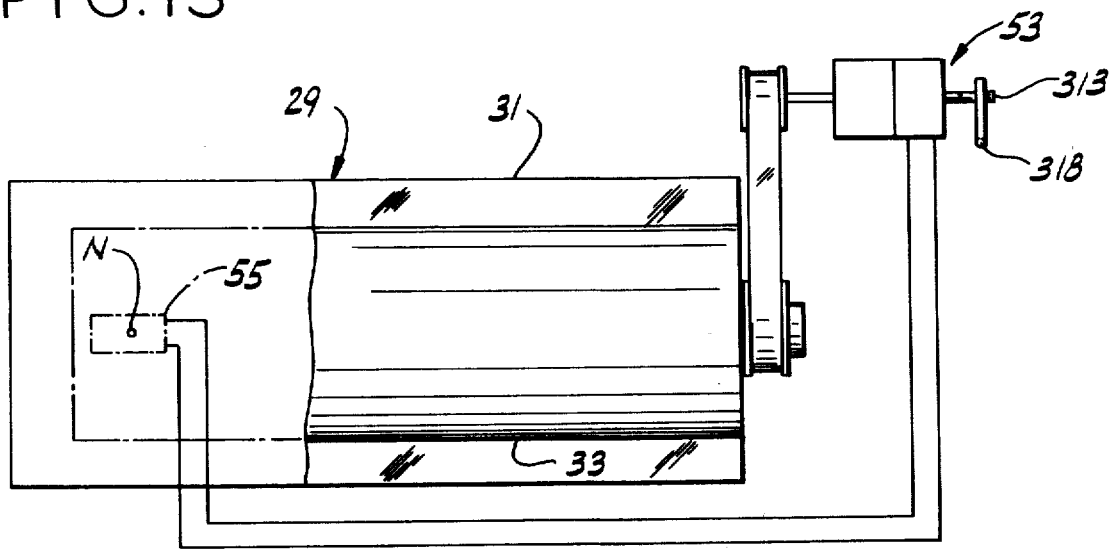
FIG. 13 is a view showing the sewing machine and a drive means and control therefor.

At 53 in FIG. 13 is generally indicated a motor and control unit, designated in its entirety by the reference numeral 53, which comprises a motor for driving the sewing machine and built-in controls for starting the motor, driving the sewing machine at a high speed for high-speed stitching (e.g., 3600 stitches per minute), driving the motor at low speed (e.g., 400 stitches per minute), and stopping the sewing machine either with the needle down in a workpiece W for utilization of the needle as a pivot for turning the workpiece, or stopping the sewing machine with the needle up for removal of the workpiece upon completion of the topstitching operation. On stopping the sewing machine with the needle up, a thread trimmer generally indicated at 55 in FIG. 13 in the bed of the sewing machine is operated automatically to cut the sewing thread to enable removal of the workpiece.

The sewing machine is a commercially available high-speed industrial machine, such as a Pfaff Model 483 machine sold by Pfaff Industriemaschinen Gmbh, of Kaiserslautern, West Germany, with the motor and control unit 53 a commercially available unit such as a Model 5G23 VARIO-STOP drive motor unit made by Teledyne-Amco, of Reading, Pennsylvania. The thread trimmer 55 is a commercially available trimmer, such as a Pfaff-900 puller trimmer incorporated in the bed of the Pfaff sewing machine. A Pfaff Model 487 sewing machine, which has a top feed as well as a bottom feed for the workpiece, may be used.

The control of unit 53 is operable to slow down the drive for the sewing machine before the machine is brought to a stop for various reasons, including more accurate stopping of the workpiece at points 17, 19 and 21. Essentially, what this control does is reduce the speed of the sewing machine from high speed (e.g., 3600 stitches per minute) to low speed (e.g., 400 stitches per minute) when, in stitching the respective seams S1, S2 and S3, the stitching (at high speed) has progressed to about one-half inch, for example, from the end 17 of S1, the end 19 of S2 and the end 21 of S3.

Means indicated generally at 59 in FIG. 12 is provided for guiding a workpiece through the sewing machine for stitching a seam (S1, S2, S3) along an edge (5, 3, 7) of the workpiece. As illustrated, this means comprises a guide 61 on the presser foot which is engageable by the edge of the workpiece being stitched and an extension means 63 movable between an operative position shown in phantom in FIG. 12 wherein it provides straight-line extensions of the guide 61 on the presser foot extending upstream and downstream from the guide 61 with the said straight-line extensions engageable by a straight edge of the workpiece being stitched, and a retracted position shown in solid lines in FIG. 12 for stitching a curved edge and for permitting turning of a workpiece (all as will appear).

Figure 10:
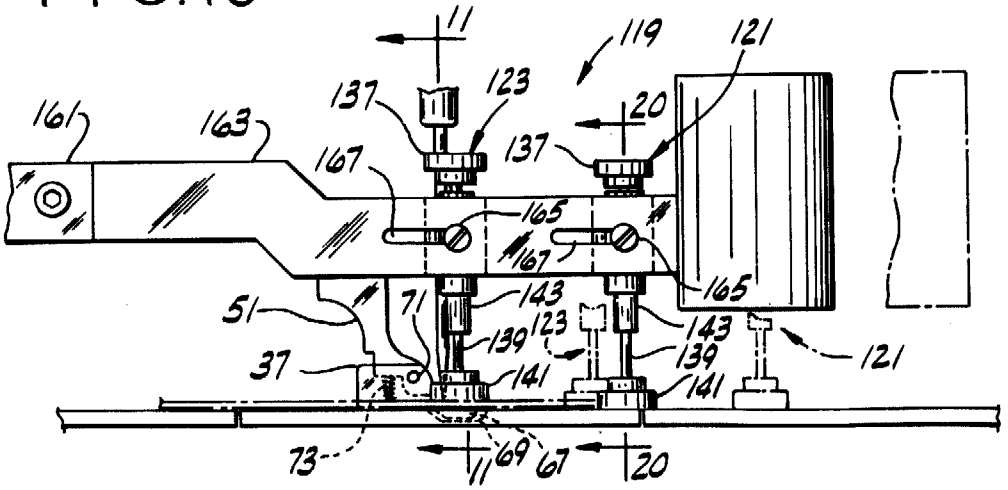
FIG. 10 is an enlarged vertical longitudinal section generally on line 10—10 of FIG. 9, showing the needle and presser foot of the sewing machine, and certain sensors of the apparatus.

The guide 61 on the presser foot comprises a downwardly extending flange on the inboard edge of the presser foot. This flange extends some distance upstream from the presser foot, and is straight throughout the major portion of its length but has its upstream end portion 65 (its trailing end portion) slightly curved outwardly away from the sewing direction. It also has a downward extension 67 at its upstream end which, when the presser foot is down, is received in a groove 69 milled out of the throat plate 39. The presser foot is pivoted at 71 on the presser foot rod 51 and biased by a spring 73 to rock counterclockwise as viewed in FIG. 10 to an angular position inclined upward in upstream direction. When the presser foot is lowered by the operation of cylinder C1, its downstream end engages a workpiece and the foot rocks clockwise for engagement of the sole of the foot with the workpiece, the presser foot being adapted to rock further clockwise against the spring bias for operation of the feed dogs 41. With the presser foot down on the workpiece, the lower edge of the guide 61 is located closely adjacent the throat plate 39 in position for having the edge of the margin of the workpiece being sewn slide along the guide 61 for the guidance of the workpiece. With the workpiece being somewhat stiff (as distinguished from being limp), and with some friction between the workpiece and the table top 25 as the workpiece slides over the table top, there is a tendency for the workpiece to turn counterclockwise as viewed from above as it is fed forward and this keeps the edge of the margin of the workpiece being sewn against the guide 61 for the guidance of the workpiece. It has also been found that the pressure of the edge of the workpiece against the guide 61 which results from the drag of the relatively stiff workpiece as it slides over the table top improves the appearance of the sewn edges of the collar.

Figure 11:
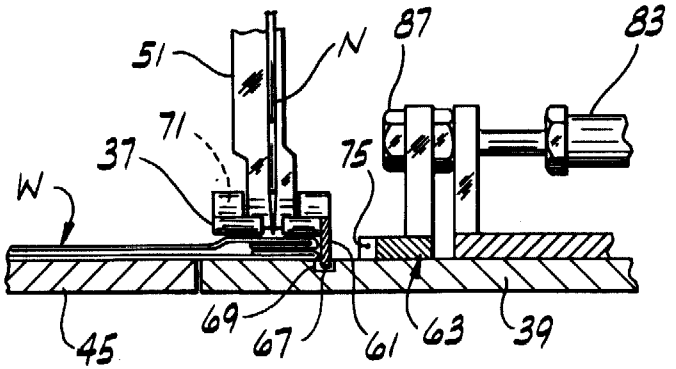
FIG. 11 is a section generally on line 11—11 of FIG. 10, parts being omitted, showing the needle and presser foot and certain appurtenant mechanism.

The guide extension means 63 comprises a flat bar having a length considerably greater than the length of the guide 61 on the presser foot (e.g., five times as long). This bar 63 has a notch 75 in edge 77 thereof, constituting its outboard edge, the notch being of a length slightly greater than the length of the guide 61 and a depth so related to the horizontal cross section of the guide that the bar 63 is adapted to occupy the operative position shown in phantom in FIG. 12 wherein portions *77a* and *77b* of said outboard edge extend upstream and downstream from the outboard face of the guide flush with said face thereby to provide straight-line extensions of the guide extending upstream and downstream from the guide. The bar 63, which may be referred to as the guide extension bar, lies flat on the throat plate 39 (see FIG. 11) and is slidable in a direction transverse to its own length and transverse to the guide 61 between its said operative position and the retracted inboard position in which it is shown in solid lines in FIGS. 11 and 12, spaced inwardly from the guide, by an air cylinder C2 mounted on a plate 81 on the bed 31 of the sewing machine under the overarm 33 of the sewing machine, this cylinder having a piston rod 83 extending from its piston (not shown) to a connection at 87 with the bar (see FIGS. 9, 11, 12, 14 and 15).

Figure 15:
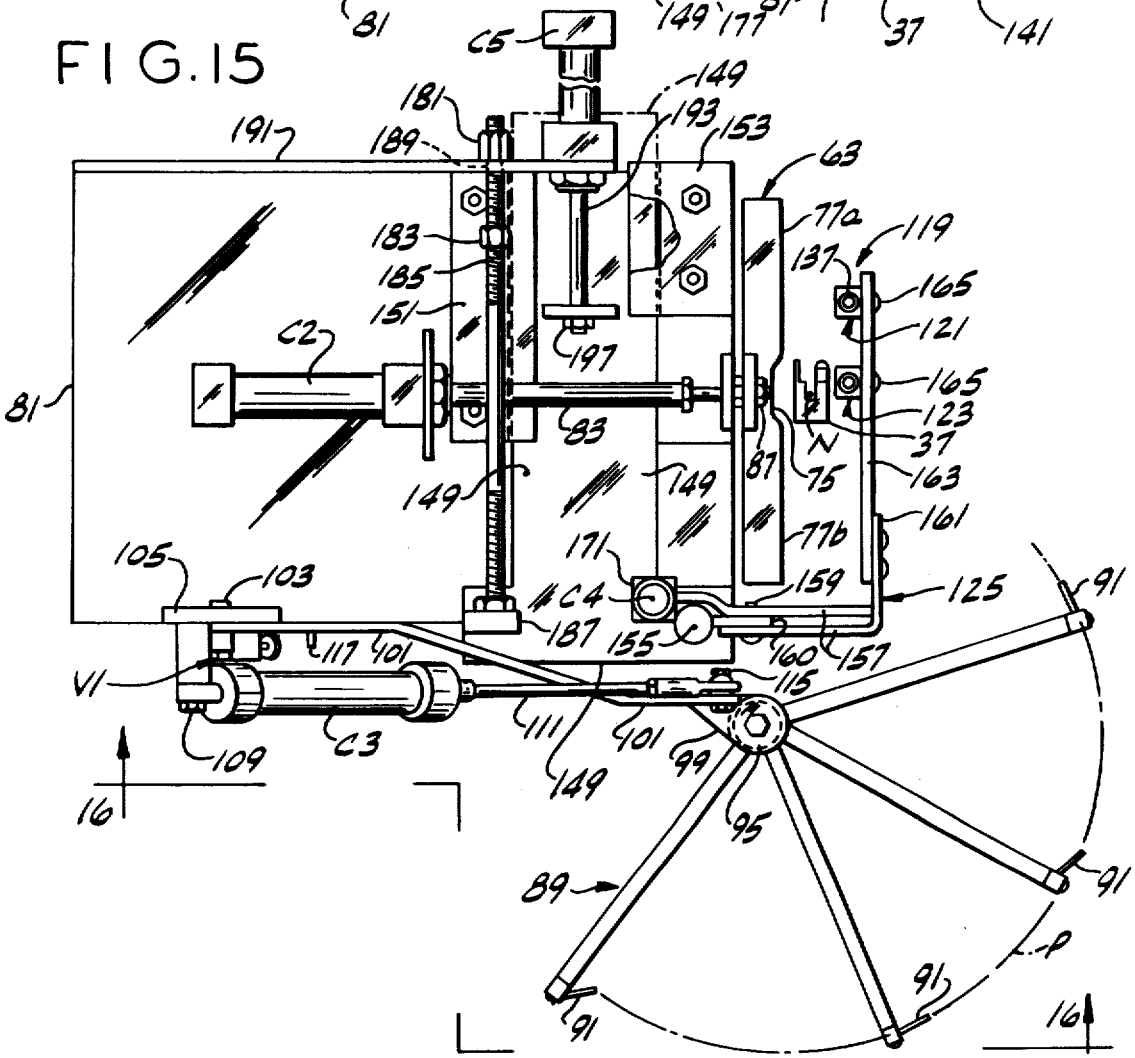
FIG. 15 is a horizontal section generally on line 15—15 of FIG. 14.
Figure 16:
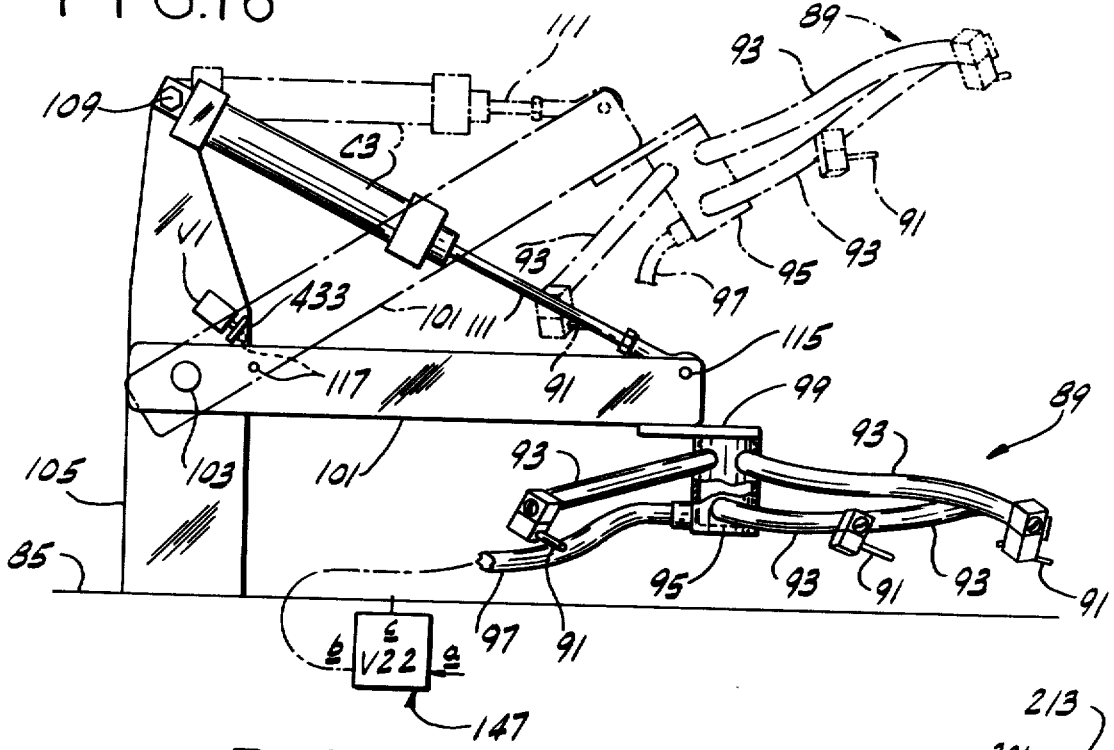
FIG. 16 is a view in elevation generally on line 16—16 of FIG. 15, and showing in phantom a raised retracted position of certain parts.

At 89 (see FIGS. 1, 3–8, 15 and 16) is indicated means operable with the needle N down in a workpiece W for blowing air on the workpiece in such direction as to turn the workpiece by blowing it around the needle as a pivot (with the presser foot 37 raised to allow for the turning of the work). This means comprises a series of air jets 91 arranged at intervals around a curved path as indicated at P in FIG. 15 with the jets angled downwardly as appears in FIG. 16 toward the table top and directed to blow streams of air downwardly on a workpiece for turning it around the needle as a pivot in the direction (counterclockwise as viewed from above) in which it is to be turned. Each jet is mounted at the end of a tubular arm 93 constituting an air supply duct for the jet, these tubular arms extending radially outwardly from a central hub 95. The hub is hollow as indicated in FIGS. 15 and 16 and constitutes a manifold for supplying air to the radial arms 93 for delivery of air to the jets 91, the hub itself being supplied with air via a flexible air line 97. The hub is mounted as indicated at 99 at the free end of an arm 101 pivoted for vertical swinging movement on a horizontal pivot at 103 on a post 105 extending up from the plate 81 on the bed of the sewing machine. The post 105 is located adjacent the downstream outboard corner of the plate 81, and the arm 101 is bent as appears in FIG. 15 so that its free end carrying the hub 95 is located somewhat downstream from the sewing machine. An air cylinder C3 is pin-connected at one end as indicated at 109 on the upper end of the post 105. A piston rod 111 extends from a piston in the cylinder through the other end of the cylinder to a pin connection at 115 with the free end of the arm, the arrangement being such that with the piston rod extended as shown in FIG. 16, the arm 101 is down in a generally horizontal position to locate the air blowing means 89 in operative position. On retraction of the piston rod 111, arm 101 is swung up to move the air blowing means 89 to the retracted position shown in phantom in FIG. 16, for a purpose that will appear. The post carries a valve V1 operable by a pin 117 on arm 101 when the arm is swung up to its retracted position.

At 119 in FIGS. 9, 10, 14 and 15 is generally indicated means which is operable as a workpiece W is being fed through the sewing machine and stitched along one edge thereof for sensing when the workpiece reaches a seam-ending position for terminating the stitching along this edge and starting the stitching along the next edge. Thus, this means is operable as a collar is being fed through the sewing machine and stitched along end edge 5 for sensing when the collar reaches the position where seam S1 ends at 17, turning the collar and starting the stitching of seam S2 along edge 3, sensing when the collar reaches the position where seam S2 ends at 19, turning the collar and starting the stitching of seam S3 along end edge 7, and sensing when the collar reaches the position where seam S3 ends at 21.

The sensing means 119 comprises a first sensor 121, which may be referred to as the slow-down or deceleration sensor, for sensing when the workpiece reaches a position which may be referred to as the slow-down position, and which is somewhat upstream from the seam-ending position of the workpiece, for slowing the workpiece down to bring it to an accurate stop at the seam-ending position, and a second sensor 123 downstream from the first sensor for sensing when the workpiece reaches its seam-ending position to stop it at the latter position. The two sensors are carried by a carriage 125, which may be referred to as the sensor shift carriage, for movement longitudinally of the apparatus to different positions for sensing the slow-down and seam-ending positions for different edges of a workpiece. The carriage 125 is shiftable longitudinally of the apparatus between a downstream position for placing the two sensors in the downstream position in which they are illustrated in FIGS. 3–6 and 15 and in solid lines in FIG. 10, and an upstream position for placing the two sensors in the upstream position in which they are illustrated in FIGS. 7 and 8 and in phantom in the FIG. 10. In the downstream position, the sensors are so located relative to the needle and the workpiece as to sense the slow-down and seam-ending positions for seams S1 and S2. In the upstream position, the sensors are so located relative to the needle and the workpiece as to sense the slow-down and seam-ending positions for seam S3.

Figure 20:
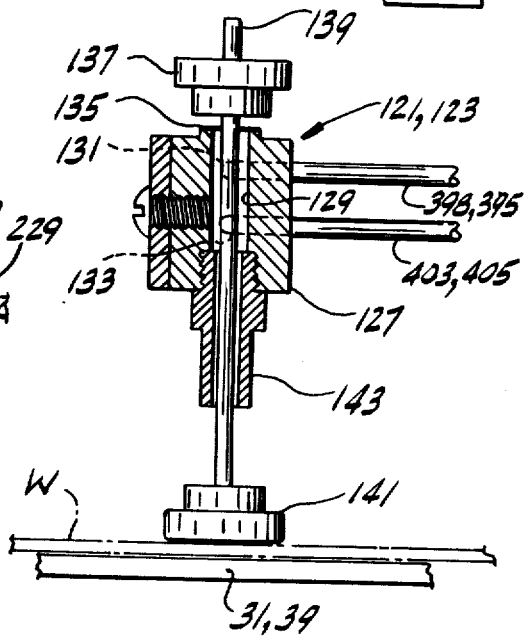
FIG. 20 is an enlarged section of a sensor generally on line 20—20 of FIG. 10.

The sensors 121 and 123 are identical, each being a pneumatic sensor comprising a valve body 127 formed with a bore 129 (see FIG. 20) extending from the upper to the lower end of the valve body and providing an air chamber. The body 127 has an air inlet 131 for flow of air under pressure to the bore or chamber 129. Air may vent from the upper end of the bore or chamber 129 (which is open to constitute a vent), or it may exit from the chamber via a lateral outlet 133 from the chamber. The body 127 is formed with a vent valve seat 135 at the upper end of the bore, and a vent valve member 137 is engageable with this seat for closing the upper end of the bore. The valve member 137 is mounted on the upper end of a rod 139 which extends down through the bore, this rod constituting a feeler controlling the valve member 137 and having a button 141 at its lower end enageable with a workpiece W as the workpiece is fed through the sewing machine over the bed of the sewing machine. The rod 139 extends through a tubular rod guide 143 threaded in the lower end of the bore 129, having a clearance fit in the guide so that there may be some leakage of air from the bore or chamber 129 out through the guide 143 around the rod 139. The valve body 127 is so positioned and the valve member 137 is so adjusted on the rod 139 that, with button 141 in engagement with a workpiece W, valve member 137 is held up in open position off the valve seat 135 for venting air from the bore or chamber 129 via the upper end of the latter. When the workpiece travels out from under the button 141, the rod 139 and valve member 137 drop (under their own weight) fpr engagement of the valve member 137 with the valve seat 135 to close the upper end of the bore or chamber 129. When the upper end of the chamber is open (the rod or feeler 139 being held up by a workpiece), air is vented from its upper end to reduce the pressure of air flowing through the outlet 133. When the workpiece slides out from under the button 141, the feeler or rod 139 drops down for engagement of the valve member 137 with the valve seat 135 to close the upper end of the chamber 129, resulting in increase in the pressure of air delivered through the outlet 133 as a signal that the valve member has closed, and thus as a signal that the trailing edge of the workpiece has travelled out from under the button 141.

The slow-down sensor 121 (which is the upstream sensor of the two sensors) senses the arrival of the trailing edge of the workpiece at a predetermined point upstream from the needle N, which point may correspond to a position of the workpiece where the workpiece has about four stitches to go, for example, to complete a seam. When it senses the arrival of the trailing edge of the workpiece at this point, it signals unit 53 to slow down the sewing machine in preparation for stopping the machine. As noted above, it may slow the machine down from a rate of 3600 stitches per minute to a rate of 400 stitches per minute. The stop sensor 123, which is the downstream sensor of the two sensors, senses the arrival of the trailing edge of the workpiece at a predetermined point upstream from the needle (and downstream from the slow-down sensor), which point corresponds to the position of the workpiece where the seam has been completed. Thus, in the case where the seam is to terminate one-fourth inch from the trailing edge of the workpiece, the stop sensor 123 senses the arrival of the trailing edge of the workpiece at a point one-fourth inch upstream from the needle for seams S1, S2 and S3. It signals unit 53 to stop the sewing machine with the workpiece at this point, with the needle down in the workpiece at the end of seams S1 and S2, and with the needle up at the end of seam S3, as will appear. It also functions to signal means indicated generally at 147 for controlling the presser foot 37, which carries guide 61, and the guide extension means 63 and for operating the blowing means to blow air on the workpiece for blowing it around when it is to be blown around, i.e., for turning it after sewing seam S1 to sew seam S2 and for blowing it around after sewing seam S2 to sew seam S3, and to actuate the thread trimmer 55 after sewing seam S3.

Figure 14:
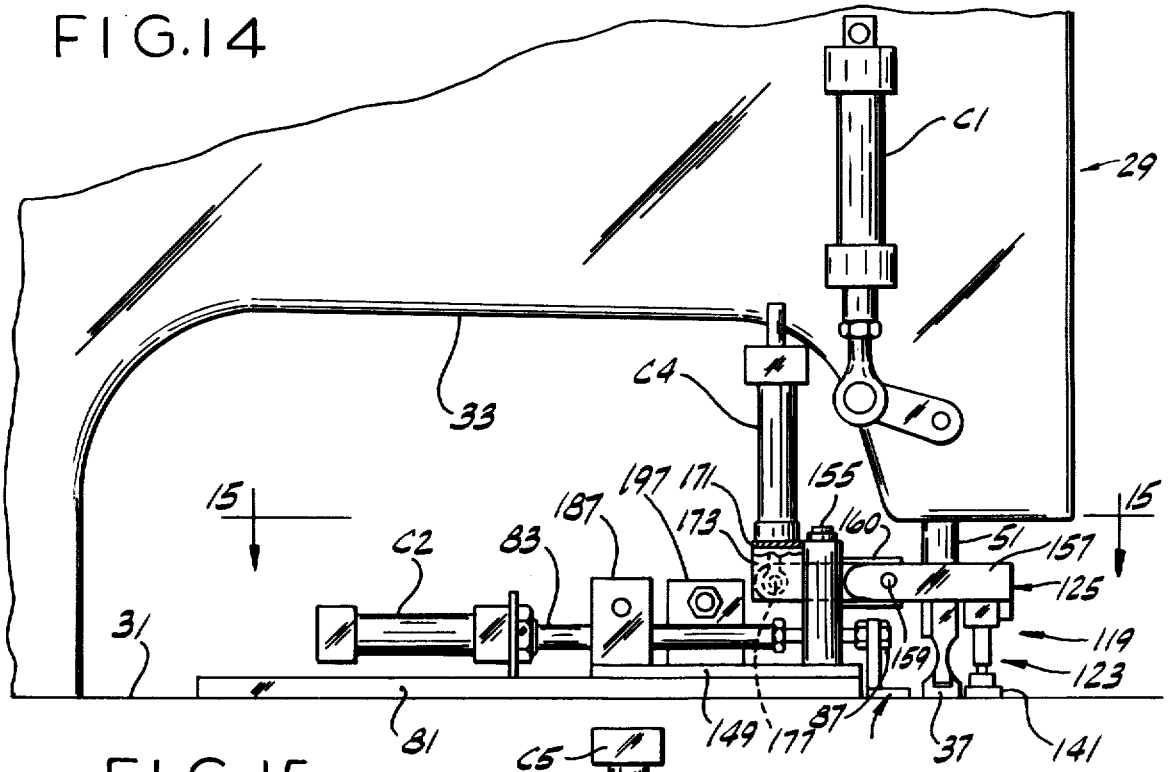
FIG. 14 is a view in elevation generally on line 14—14 of FIG. 1, on a larger scale than FIG. 1.

Referring now more particularly to FIGS. 14 and 15, the sensor shift carriage 125, which carries the sensors 121 and 123, is shown to comprise a slide plate 149 guided for longitudinal sliding movement on the plate 81 by means of guides 151 and 153 secured on top of the plate 81. Extending up from this slide plate at its downstream end is a post 155. A lever 157 pivoted at 159 on a bracket 160 on this post has an arm 161 extending in upstream direction. Secured to this arm is an extension 163 carrying the sensors 121 and 123, the securement of the sensors being by means of screws 165 extending through slots 167 in the extension 163 providing for adjustment of the sensors longitudinally of the extension. An air cylinder C4 is provided for swinging the lever 157 to raise and lower the arm 161 and its extension 163 to raise and lower the sensors. This air cylinder is mounted on a bracket 171 on the post extending up from the bracket. Its piston rod 173 extends down through its lower end from a piston therein to a connection at 177 with lever 157. An air cylinder C5 is provided for sliding the plate 149 to move the sensors 121 and 123 longitudinally. The longitudinal movement of the plate 149 and hence the longitudinal movement of the sensors is controlled by stops 181 and 183 adjustably threaded on a threaded rod 185 secured to the slide plate 149 at 187, this rod extending through a hole 189 in a flange 191 on the plate 81. The cylinder C5 is secured at its head end to this flange 191. Its piston rod 193 extends from a piston therein through the flange 191 to a connection at 197 with the slide plate 149. The slide plate and hence the sensors are longitudinally movable between the downstream position in which they appear in FIG. 15 wherein piston rod 193 is extended and stop 181 engages the flange 191 and an upstream position wherein the piston rod 193 is retracted and stop 183 engages the flange 191 (see the phantom position of plate 149 in FIG. 15 and the phantom position of the sensors in FIG. 10).

When the sewing of the first seam S1 along edge 5 of the workpiece W has been completed, the sewing machine stops with the needle down in the workpiece at 17 (so that the needle may serve as a pivot for turning the workpiece), presser foot 37 is raised, guide bar 63 is retracted, and the air blowing means 89 then functions to blow the workpiece around (in counterclockwise direction as viewed from above). At 201 is indicated a first stop means engageable by the edge 3 of the workpiece, which is the next edge of the workpiece to be seamed, as the workpiece is being blown around to stop the workpiece in the second seam starting position shown in FIG. 5 for stitching the second seam S2 along edge 3. When the sewing of seam S2 along edge 3 has been completed, the sewing machine again stops with the needle down in the workpiece at 19, presser foot 37 is raised, guide bar 63 is retracted, and the air blowing means 89 again functions to blow the workpiece around. At 203 is indicated a second stop means engageable by the edge 1 of the workpiece, which is the edge opposite the edge 7 to be seamed, as the workpiece is being blown around the second time to stop the workpiece in the third seam starting position shown in FIG. 7 for stitching the third seam S3 along edge 7. This second stop means occupies a raised retracted position clear of the workpiece on the table top 25 when the workpiece is undergoing its first turn, and is brought down to a lowered operative position just before the workpiece makes its second turn for engagement by the workpiece to stop it in its third seam starting position.

Figure 17:
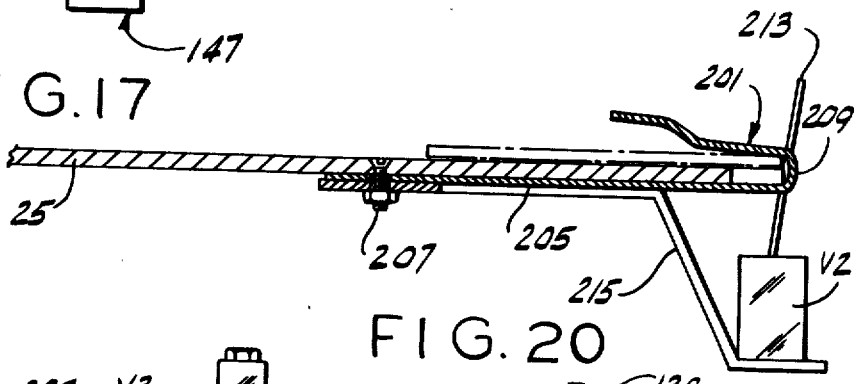
FIGS. 17, 18 and 19 are enlarged sections generally on lines 17—17, 18—18 and 19—19, respectively, of FIG. 1.

The first stop means 201 is located at the right side of the table top upstream from the sewing machine. It comprises a member in the form of a hook (see FIG. 17) having a shank portion 205 adjustably secured to the underside of the table top 25 as indicated at 207, the shank extending out from under the table top at the right side of the latter and having a portion bent up and back over itself to provide a stop 209 engageable by the edge 3 of the workpiece as it is blown around from the FIG. 4 position to stop the workpiece in the FIG. 5 position. An air valve V2 is mounted adjacent the stop 209 having a trip wire 213 extending upwardly in position for engagement by the edge 3 of the workpiece as it approaches the stop for actuating the valve for triggering the next operation in the sequence of operation of the apparatus, as will appear. The valve V2 is mounted as indicated at 215 for adjustment of its position, and slots such as indicated at 217 are provided in the table top for accommodating the trip wire in various positions of adjustment of the valve.

Figure 18:
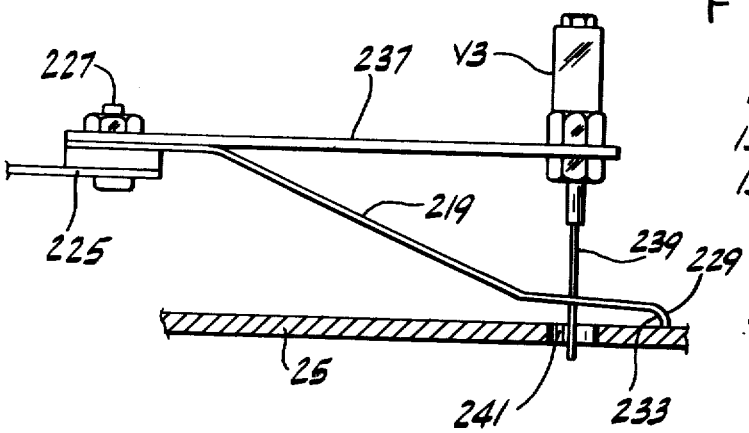
Figure 19:
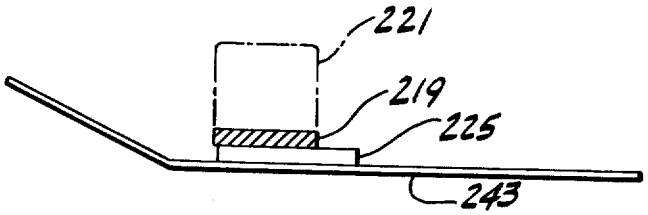

The second stop means 203 comprises a plate 219 (see FIGS. 1, 9 and 18) mounted at the right end of an arm 221 (FIGS. 1 and 9) pivoted as indicated at 223 at the left side of the table 23 and extending toward the right over the table. The plate 219 is secured to a bracket 225 which is adjustably mounted on the arm as indicated at 227. It is inclined downwardly toward the table top 25 and has a downwardly directed flange 229 at its lower edge constituting the stop proper of the stop means. The arm 221 is swingable by an air cylinder C6 (FIG. 9) to move the stop down from a raised retracted position, wherein the lower edge of the stop 229 is clear of the table top 25 to allow a workpiece W to travel under the stop 229 into engagement with the first stop 201, and a lowered operative position wherein the lower edge of the stop 229 engages the table top 25 and the face 233 of the stop is engageable by edge 1 of the workpiece being turned. An air valve V3 (FIG. 18) is adjustably mounted on the bracket 225 as indicated at 237, this valve having a trip wire 239 extending downwardly for engagement by the edge 1 of the workpiece as this edge approaches the stop 229 for actuating the valve, for triggering the next operation in sequence of the apparatus as will appear. When the stop 229 is down in its operative position, the trip wire extends down into an opening 241 in the table top. A guide plate 243 (FIG. 19) is carried by the bracket 225 for guiding the workpiece under the bracket.

The apparatus includes what may be referred to as loading means, indicated generally at 245 (see FIGS. 1 and 3) for entering a workpiece W to be sewn into the sewing machine, and what may be referred to as unloading means indicated generally at 247 (see FIGS. 1 and 8) for removing a sewn workpiece from the sewing machine and from the table top, and stacking the workpiece. Generally, the loading means 245 functions to grip a workpiece placed on the table top 25 at a position indicated at W1 in FIG. 1, slide the workpiece over the table top to the first seam starting position W2 of the workpiece shown in FIG. 3, and then retract. The unloading means 247 functions to grip a completed workpiece W and slide it over the table top and off the downstream end of the table top, for stacking up completed workpieces in a receiver 249.

Figure 3:
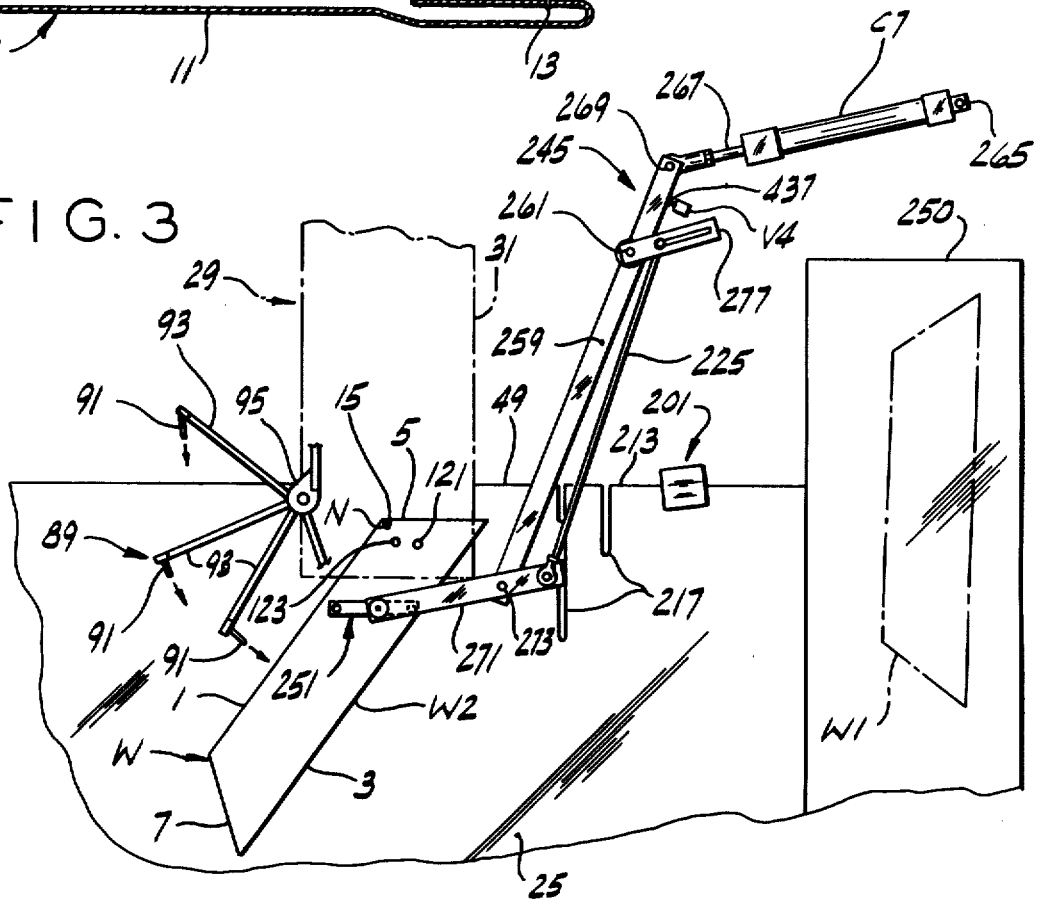
FIG. 3 is a partial plan showing the collar entered in the sewing machine to start the topstitching operation, more particularly to start the stitching of a seam along one end edge of the collar.

The table top has an extension 250 at its upstream (rearward) end which extends to the right at the rear of the sewing machine. The loading means 245 comprises a gripper 251 and means indicated generally at 253 carrying the gripper for vertical movement between a raised retracted position above the table between a raised retracted position above the table top 25 and a lowered position wherein it engages the upper surface of a workpiece on the table top for gripping the workpiece to slide it over the table top, and for movement of the gripper over the table top from the rearward retracted position above the table top extension in which it is illustrated in FIG. 1 (where it initially grips a workpiece), to the forward delivery position in which it is illustrated in FIG. 3 wherein it has entered the workpiece in the sewing machine with the workpiece in its first seam starting position as indicated at W2.

The gripper comprises a resilient pad 255 on the bottom of a bar 257. The means carrying the gripper comprises a lever 259 pivoted for swinging movement intermediate its ends as indicated at 261 on a vertical axis located between the sewing machine and the table top extension 250, to the right of the right end edge 49 of the table top 25. This lever 259 is swingable from the retracted position in which it appears in FIG. 1 extending generally rearward (in upstream direction) from the pivot 261, to the advanced position in which it appears in FIG. 3 extending laterally from the pivot over the table top 25 (and angled somewhat forward). An air cylinder C7 is provided for swinging the lever between its retracted and advanced positions, the cylinder being pivoted at one end as indicated at 265 and having its piston rod 267 extending from its piston through its other end to a pin connection at 269 with one end of the lever 259. The gripper 251 is carried by an arm 271 pivoted at 273 on the other end of the lever. A link 275 interconnects arm 271 and a fixed arm 277 extending radially from the axis of the pivot 261 for swinging the arm 277 relative to the lever 259 as the lever swings, for a purpose that will appear. The gripper 251 is spring-mounted as indicated at 279 on the lower end of the piston rod 281 of an air cylinder C8 mounted in vertical position at the outer end of the arm 277. The piston rod is suitably held against rotating on its axis to hold the gripper 251 in the angular position relative to the arm 271 in which it appears in FIGS. 1 and 3. An air valve V4 located as shown in FIGS. 1 and 3 is operable by the lever 259 when the latter swings to its advanced position of FIG. 3 and enters a workpiece W in the sewing machine to start the sewing of the workpiece. It is also manually operable to start sewing a manually entered workpiece, as will appear.

The unloading means 247 comprises a gripper 283 and means indicated generally at 285 carrying the gripper 283 for vertical movement between a raised retracted position above the table top 25 and a lowered position wherein it engages the upper surface of a completed workpiece W on the table top for gripping the workpiece to slide it over the table top, and for movement of the gripper over the table top from the forward retracted position in which it is illustrated in FIG. 1, to the rearward workpiece-engaging position in which it is illustrated in FIG. 8, and back to its retracted position for sliding the workpiece out of the sewing machine and over the forward edge 287 of the table top, whereupon the workpiece falls into the receiver 249.

The gripper 283 is similar to the gripper 251, comprising a resilient pad 255 on the bottom of a bar 257. The means carrying the gripper 283 comprises a lever 291 for swinging movement as indicated at 293 on a vertical axis located forward of the sewing machine and at the right of the table top 25. This lever 291 is swingable from the forward retracted position in which it appears in FIG. 1 angled over the forward right-hand corner of the table top, with the outer end portion of the lever located over the receiver 249, to the rearward position in which it appears in FIG. 8 angled back toward the sewing machine and extending over the table top forward of the sewing machine. An air cylinder C9 is provided for swinging the lever 291 between its forward and rearward position, the cylinder being pivoted at one end as indicated at 297 and having its piston rod 299 extending from its piston through its other end to a pin connection at 301 with a crank arm 303 on the lever. The gripper 283 is carried by an arm 305 pivoted at 307 on the outer end of the lever 291. A link 308 interconnects arm 305 and a fixed arm 309 extending radially from the axis of the pivot 293 for swinging the arm 305 relative to the lever 291 as the lever swings, for a purpose that will appear. The gripper 283 is spring-mounted as indicated at 279 on the lower end of the piston rod 311 of an air cylinder C10 mounted in vertical position at the outer end of the arm 305. The piston rod is suitably held against rotating on its axis to hold the gripper 283 in the angular position relative to the arm 305 in which it appears in FIGS. 1 and 8 extending down through an opening in the arm. The air blowing means 89 is swung up to its FIG. 16 phantom position clear of the unloading means 247 by cylinder C3 when the gripper 283 is swung rearward to grip a completed workpiece. An air valve V5 is operable by the crank arm 303 on the lever 291 on movement of the lever to its retracted (or stacking) position of FIG. 1, to trigger the next operation in the sequence of operation of the apparatus, as will appear.

The built-in controls of the motor and control unit 53 generally involve a switch mechanism operable by a cam (not shown) on a camshaft 313 (see FIGS. 13 and 23C) to a neutral position in which the sewing machine 29 is stopped with the needle N down, a high-speed position in which the sewing machine is driven at a relatively high speed (e.g., 3600 stitches per minute), a low-speed position in which the sewing machine is driven at a relatively low speed (e.g., 400 stitches per minute) and a thread trim position in which the sewing machine is stopped with the needle raised and the thread trimmer 55 is actuated to trim the thread (at the end of stitching the third seam S3).

Figure 23A:
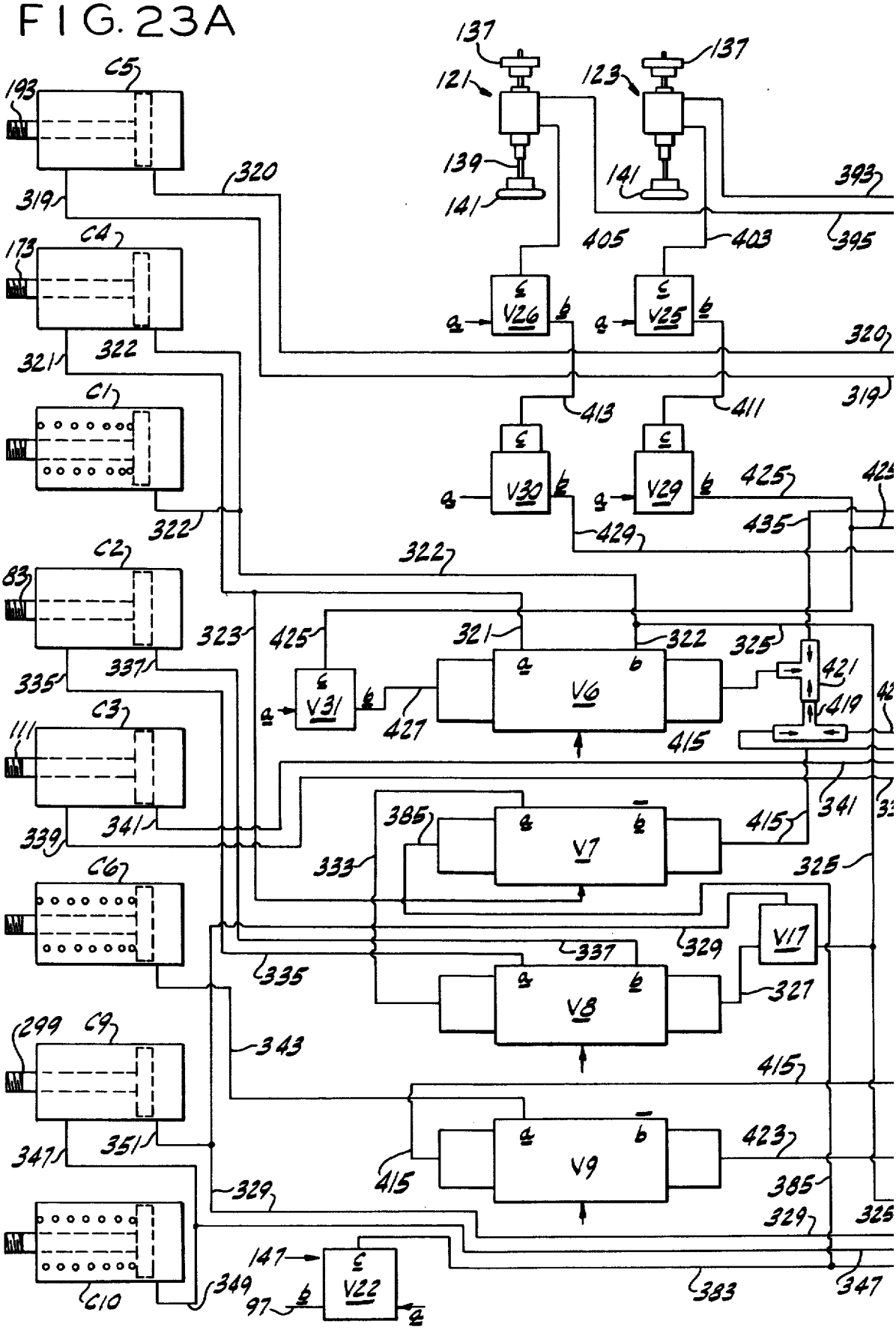
FIGS. 23A, 23B and 23C together constitute a pneumatic circuit diagram.
Figure 23B:
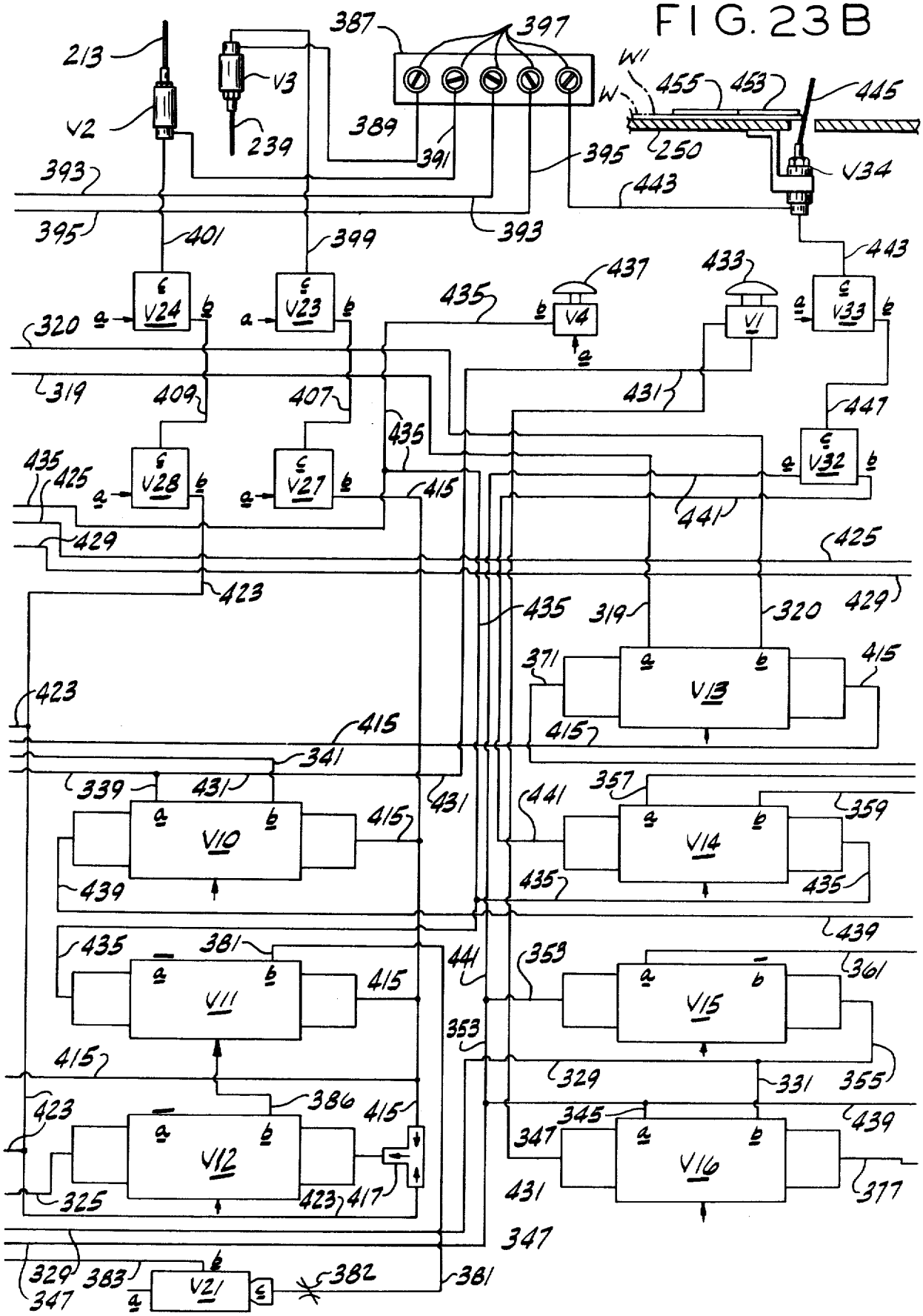
Figure 23C:
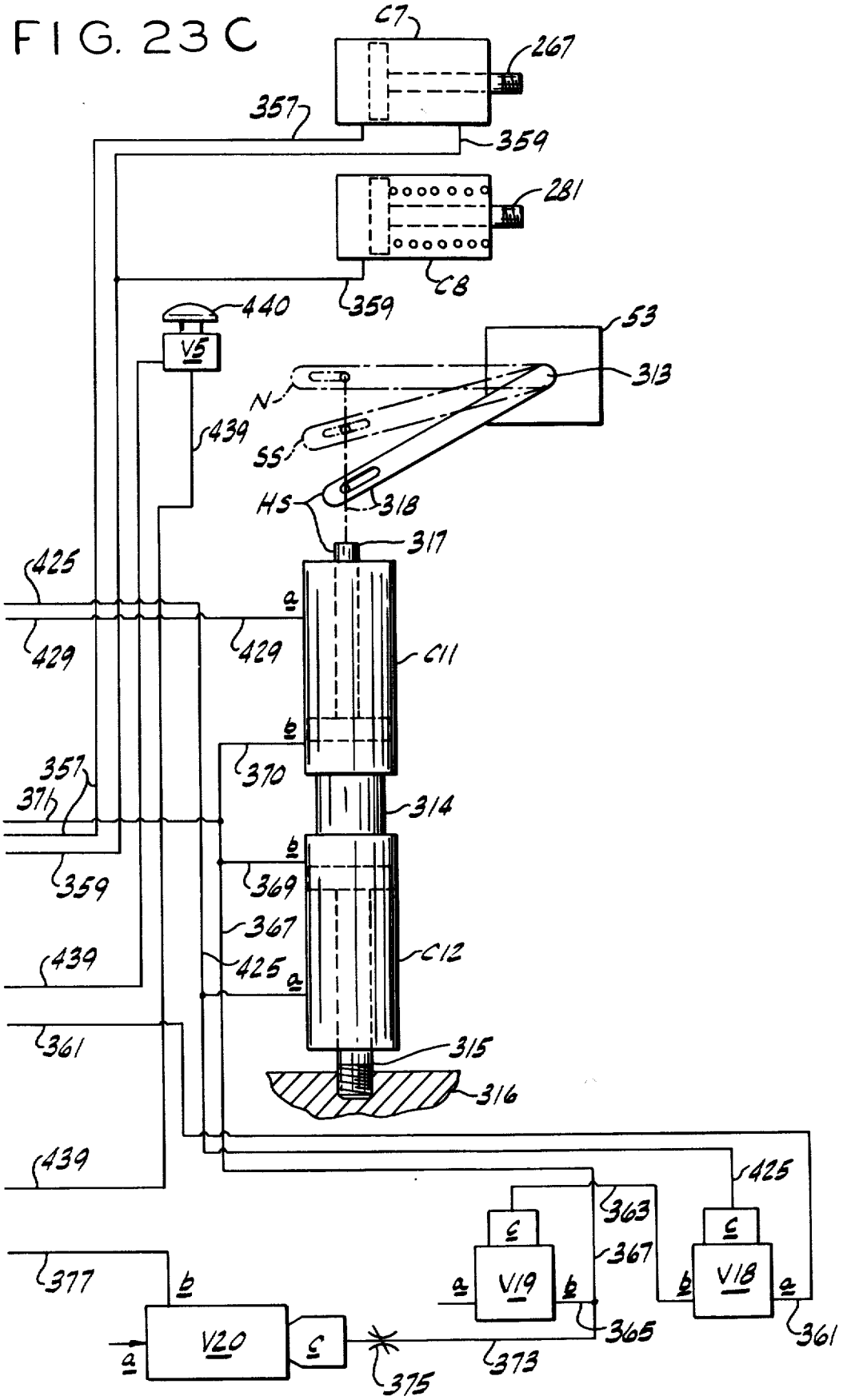

Referring to FIG. 23C, a dual air cylinder unit comprising a pair of air cylinders C11 and C12 interconnected end-to-end and arranged oppositely in tandem is provided for operating the camshaft 313. Each cylinder has a forward port a and a rearward port b, and the cylinders are interconnected as indicated at 314 at their rear ends. The piston rod 315 of cylinder C12 is secured to a fixed abutment 316 and the piston rod 317 of cylinder C11 is connected as indicated at 318 to operate the camshaft 313. Piston rod 317 of cylinder C11 has a shorter stroke than piston rod 315 of cylinder C12. With ports a and b of both cylinders vented, spring means (not shown) in the unit 53 (this spring means already being in the unit as supplied by the manufacturer) biases the camshaft 313 to its neutral position for stopping the sewing machine with the needle down, the piston rod 317 and cylinders C11 and C12 being accordingly shifted to a corresponding neutral position (indicated at N in FIG. 23C). On supplying air to port a and venting port b of cylinder C12, cylinder C12 moves down to the lower limit of its stroke (note that the piston rod 315 of cylinder C12 is fixed). This pulls down cylinder C11, which in turn pulls down its piston rod 317 to the slow-speed position such as indicated in phantom at SS in FIG. 23C for driving the sewing machine at the low speed. With cylinders C12 and C11 down, on supplying air to port a and venting port b of cylinder C11, piston rod 317 of cylinder C11 is driven down to a retracted position relative to cylinder C11, thus bringing rod 317 down to the high-speed position such as indicated at HS in FIG. 23C for driving the sewing machine at the high speed. On supplying air to port b and venting port a of each cylinder, cylinder C12 is driven up to the upper limit of its stroke, driving cylinder C11 up to the upper limit of the stroke, and extending piston rod 317 of cylinder C11, thus bringing rod 317 to the position for stopping the sewing machine with the needle up and operating the thread trimmer 55.

In essence, the operation of the dual cylinder unit C11, C12 is an automation of the conventional foot pedal operation of the unit 53 with the controls for stopping with the needle down, stopping with the needle up and trimming the thread, and operating the sewing machine at different speeds.

Referring to FIGS. 23A and 23B, the apparatus is shown to comprise valves V6–V16 for controlling the cylinders C1–C12 (see FIGS. 23A and 23C), each of these valves being of the type having an inlet for air under pressure (indicated by an arrow) and a spool (not shown) shiftable by an air-operated pilot at the right to direct air under pressure from the inlet to a port a and to connect a port b to atmosphere, and shiftable by an air-operated pilot at the left to direct air under pressure from the inlet to port b and to connect port a to atmosphere. Each of valves V6–V16 is of a type which resets automatically after having been actuated by air pressure.

Valve V13 controls cylinder C5 for shifting sensors 121 and 123 between their upstream and downstream positions, via a line 319 interconnecting its port a and the forward (piston rod) end of this cylinder and a line 320 interconnecting its port b and the rear end of the cylinder.

Valve V6 controls cylinders C4 and C1 via a line 321 interconnecting its port a and the forward end of cylinder C4 and a line 322 interconnecting its port b with the rear ends of cylinders C4 and C1. Cylinder C1 is a spring return cylinder. A line 323 interconnects line 321 and the air inlet of valve V7. A line 325 interconnects line 322 and the left-hand pilot of valve V12. A line 327 including a normally open air-piloted valve V17 interconnects line 325 and the right-hand pilot of valve V8. A line 329 interconnects line 331 from port b of valve 16 and the pilot of valve V17.

Valve V7 is a control valve for valve V8 via a line 333 interconnecting port a of valve V7 and the left-hand pilot of valve V8. Port b of valve V7 is blocked.

Valve V8 controls cylinder C2 for shifting the guide extension bar 63 via a line 335 interconnecting its port a and the forward end of the cylinder C2 and a line 337 interconnecting its port b and the rear end of the cylinder C2.

Valve V10 controls cylinder C3 for raising and lowering the air blowing means 89 via a line 339 interconnecting its port a and the forward end of the cylinder C3 and a line 341 interconnecting its port b and the rear end of the cylinder.

Valve V9 controls cylinder C6 for raising and lowering the arm 221 of the second stop means 203 via a line 343 interconnecting its port a and the rear end of this cylinder, which is a spring return cylinder. Port b of valve V9 is blocked.

Valve V16 controls cylinders C9 and C10 for operating the unloader 247 via a line 345 interconnecting its port a and a line 347 connected to the forward end of cylinder C9 and a line 349 connected to the rearward end of cylinder C10, and a line 351 interconnecting line 329 (interconnected with port b of valve V16 via line 331) with the rearward end of cylinder C9. Cylinder C10 is a spring return cylinder. Port a of valve V16 is also connected via lines 345 and 347 to a line 353 leading to the left-hand pilot of valve V15, and port b of valve V16 is also connected via line 331 to a line 355 leading to the righthand pilot of valve V15.

Valve V14 controls cylinders C7 and C8 of the loader 245 via a line 357 interconnecting port a of the valve and the rear end of cylinder C7 and a line 359 interconnecting port b of the valve and the forward end of cylinder C7 and the rearward end of cylinder C8, the latter being a spring return cylinder.

Valve V15 is a control valve for cylinders C11 and C12, and for valves V13 and V16. Its port b is blocked. A line 361 connects its port a to the air inlet of a valve V18. This valve is of a type having air inlet a, and air outlet b and an air pilot c, normally being closed and opening for flow of air from the inlet a to the outlet b on delivery of air to the pilot c. A line 363 connects the outlet of valve V18 to the pilot c of a valve V19, the latter being of a type having an air inlet a, an air outlet b and the air pilot c, normally being closed and opening flow of air from the inlet a to the outlet b on delivery of air to the pilot c. The air inlet a is supplied with air under pressure from a suitable source (not shown). Outlet b of valve V19 is connected by a line 365 to a line 367 which has a branch 369 connected to the rear end of cylinder C12, and a branch 370 connected to the rear end of cylinder C11, and a branch 371 connected to the lefthand actuator of valve V13. Outlet b of valve V19 is also connected by the line 365 to a line 373 including a flow control 375 connected to the air pilot c of a time-delay valve V20. The latter has an air inlet a receiving air under pressure from the source and an outlet b connected by a line 377 to the right-hand pilot of valve V16. Valve V20 is normally closed; it is adapted to open after a time delay when air is delivered to its pilot c.

Delivery of air to the air blowing means 89 is controlled by a system of valves including valves V11 and V12, an air-actuated time-delay valve V21 and a normally closed air-actuated valve V22. The latter has an inlet a to which is connected a source of high pressure dry air, an outlet b and an air pilot c. The line 97 interconnects the outlet b and the hollow hub 95 of the air blowing means. A line 381 including a flow control 382 interconnects port b of valve V11 and the pilot c of the time-delay valve V21, and a line 383 interconnects the air outlet b of the time-delay valve V21 and the pilot c of valve V22. Port a of each of valves V11 and V12 is blocked. The arrangement is such that on delivery of air from port b of valve V11 to the pilot c of time-delay valve V21, the latter opens after a time delay and delivers air via line 383 to the pilot c of valve V22, which thereupon opens to deliver air via line 97 to the air blowing means 89. Line 383 also delivers air via a line 385 to the left-hand pilot of valve V7. A line 386 interconnects port b of valve V12 and the inlet of valve V11.

At 387 in FIG. 23B is indicated a source (e.g., a tank) of relatively low pressure air. Lines 389, 391, 393 and 395, each including a flow control 397, supply low pressure air from this source to the air inlets of valves V3 and V2 and the air inlets 131 of sensors 123 and 121, respectively. The outlets of valves V3 and V2 and the outlets 133 of sensors 123 and 121 are connected via lines 399, 401, 403 and 405, respectively, to the pilots at c of valves V23, V24, V25 and V26, each of the latter having an inlet a to which is connected the source of high pressure air and an outlet b, and being of a type which is open for flow of air from a to b as long as air is supplied to its pilot at c and which closes when it loses the pilot signal. Outlets b of valves V23–V26 are connected via lines 407, 409, 411 and 413, respectively, to the pilots at c of valves V27, V28, V29 and V30, each of the latter having an inlet a which is connected to the source of high pressure air and an outlet b, and being of a type which is closed against flow from a to b when its pilot at c receives pilot air and which is opened for flow of air from a to b when the pilot air is cut off.

Outlet b of valve V27 is connected via a system of lines 415 with the right-hand pilots of valves V10 and V11, a shutter valve 417 connected to the right-hand actuator of valve V12, a shuttle valve 419 connected via a shuttle valve 421 to the right-hand pilot of valve V6, the left-hand pilot of valve V9, the right-hand pilot of valve V7, and the right-hand pilot of valve V13. Thus, whenever valve V27 opens, air is supplied to the right-hand pilots of valves V10, V11, V12, V6, V7 and V13, and to the left-hand pilot of valve V9.

Outlet b of valve V28 is connected via a system of lines 423 with the shuttle valves 419 and 417 and with the right-hand pilot of valve V9.

Outlet b of valve V29 is connected via a system of lines 425 with port a of cylinder C12, with the pilot c of valve V18, and with the pilot of an air-actuated valve V31 having an inlet a connected to the source of high pressure air and an outlet b connected by a line 427 to the left-hand actuator of valve V6. Valve V31 is normally open for supplying air to the left-hand actuator of valve V6, and closes to cut off air thereto when valve V29 cuts off pilot air from the V31 pilot.

Outlet b of valve V30 is connected via a line 429 to port a of cylinder C11.

Valve V1 is a normally closed valve interconnected in a line 431 between port a of valve V10 and the left-hand pilot of valve V16. When its button 433 is actuated by pin 117 on arm 101 when the latter swings up to retract the air blowing means 89, it opens to supply air to the left-hand pilot of valve V16.

Valve V4 is a normally closed valve having an inlet a for high pressure air from the source and an outlet b connected via a system of lines 435 to the shuttle valve 421, the left-hand pilot of valve V11 and the right-hand pilot of valve V14 for supplying air thereto when its button 437 is actuated to open it.

Valve V5 is a normally closed valve interconnected in a line 439 between port a of cylinder V16 and the left-hand pilot of valve V10 for supplying air to the latter when the button 440 of valve V5 is actuated.

A line 441 including a valve V32 is interconnected between line 353 and the left-hand pilot of valve V14. Valve V32 is of a type which is normally open for flow of air from its port a to its port b when its pilot c is deactuated, and which closes to cut off flow of air therethrough when the pilot is supplied with air. The supply of air to the pilot of valve V32 is under control of a valve V33 (which is similar to valves V23–V26) having an inlet a to which is connected the source of high pressure air and an outlet b, which is open for flow of air from a to b as long as air is supplied to its pilot at c, and which closes when it loses its pilot signal. The pilot of valve V33 is under control of a normally closed valve V34 connected in a line 443 between the tank 387 and the pilot, this line 443 including a flow control 397. Valve V34 has a trip wire 445 (see FIGS. 1 and 23B) engageable by a collar properly placed in position W1 for actuating the valve to cut off delivery of pilot air via line 443 to valve V33. This causes valve V33 to close, cutting off pilot air via line 447 to valve V32. This deactuates valve V32, thereby permitting flow of air through line 441.

Operation is as follows:

At the start of operation on a series of collars W, the sewing machine 29 is off with the needle N up, and with the presser foot 37 up (via cylinder C1). The guide bar 63 is in its extended work-guiding position (shown in phantom in FIG. 12) via extension of the piston rod 83 of cylinder C2. The air blowing means 89 is down in its lowered operative position (shown in solid lines in FIG. 16) via extension of the piston rod 111 of cylinder C3. The sensors 121 and 123 are up in their raised retracted position via extension of the piston rod 173 of cylinder C4, and in their downstream position shown in FIGS. 3–6 and 15 and in solid lines in FIG. 10 via extension of piston rod 193 of cylinder C5. Stop 229 is up as a result of arm 221 having been swung to bring it up via retraction of the piston rod of cylinder C6. The lever 259 of the loader 245 is in its retracted position of FIG. 1 via extension of the piston rod of cylinder C7, and the gripper 251 of the loader is up via retraction of piston rod 281 of cylinder C8. The lever 291 of the unloader 247 is in its retracted position of FIG. 1 via retraction of piston rod 299 of cylinder C9, and the gripper 283 of the unloader is down as a result of piston rod 311 of cylinder C10 being extended.

To start the operation, the first collar W of a series of collars to be topstitched is manually entered in the sewing machine 29 in the W2 position shown in FIG. 3 for sewing the first seam S1. In this W2 position of the collar, the starting point 15 of the first seam S1 to be sewn is directly under the needle N (which together with the presser foot 37 is raised at this time). The edge 77*a* of bar 63 serves as a gauge for positioning the collar, the end edge 5 of the collar being engaged against edge 77*a* of the bar as illustrated in phantom in FIG. 12. The operator then manually actuates valve V4 (by pushing its button 437), thereby opening this valve to deliver air from the source of high pressure air throughout the system of lines 435, and the operation proceeds as follows:

1. Valve V4 supplies air via 435;

a. To shuttle 421 and thence to the right-hand pilot of valve V6, thereby actuatvalve V6 for delivery of air through its port a and venting of air through its port b;

b. To the right-hand pilot of valve V14, thereby actuating this valve for delivery of air through its port a and venting of air through its port b; and c. To the left-hand pilot of valve V11, thereby actuating this valve for delivery of air through its port b when valve V11 is supplied with air from port b of valve V12 via line 386.

2. As a result of step 1a, air is delivered from port a of valve V6 via line 321 to the forward end of cylinder C4 and the rear end of this cylinder is vented via line 322 and port b of valve V6 to retract the piston rod 173 of cylinder C4 and thereby lower the sensors 121 and 123 for engagement of their buttons 141 with the collar at W2 (see FIGS. 10 and 14). This raises the valve member 137 of each sensor off its seat 135 (see FIG. 20) to vent chamber 129 of each sensor.

3. Further as a result of step 1a, air is vented from the rear end of cylinder C1 via line 322 and port b of valve V6. The piston rod of cylinder C1 is thereupon retracted by a spring in this cylinder to effect lowering of the presser foot 37 into engagement with the collar at W2.

4. Further as a result of step 1a, air is delivered from port a of valve V6 via lines 321 and 323 to the inlet of valve V7, which at this time is in neutral. This prepares this valve for subsequent operation to deliver air to the left-hand pilot of valve V8.

5. As a result of step 1b, air is delivered from port a of valve V14 via line 357 to the rear end of cylinder C7 and vented from the forward end of this cylinder via line 359 and port b of valve V14 to hold the piston rod 267 of cylinder C7 extended thereby to hold lever 259 of the loader 245 and gripper 251 of the loader in the retracted position of FIG. 1. The rear (upper) end of cylinder C8 is also vented via line 359, as a result of which the gripper 251 is held raised by a spring in cylinder C8 (see FIG. 21).

6. As a result of chambers 129 of the sensors 121 and 123 being vented (step 2), the pilots of valves V25 and V26 lose air via lines 403 and 405, and these valves are deactuated (closed) to cut off delivery of air therethrough and to vent their transfer ports b. This vents the pilots of valves V29 and V30 via lines 411 and 413, as a result of which valves V29 and V30 are deactuated and open. Valve V30 thereupon supplies air via line 429 to port a of cylinder C11. Valve V29 thereupon supplies air via 425 to port a of cylinder C12 and also to the pilots of valves V18 and V31. Valve V18 is thereby actuated (closed) to cut off delivery of air therethrough, at the same time venting the pilot of valve V19 via line 363. Valve V19 is thereby deactuated and closes to cut off delivery of air therethrough, at the same time venting ports b of cylinders C11 and C12 via line 367 and the pilot of valve V20. With air supplied to ports a and vented from ports b of cylinders C11 and C12, rod 317 is brought down to its high-speed position for driving the sewing machine 29 at high speed (e.g., 3600 stitches per minute).

7. The collar W is fed forward through the sewing machine from the position W2 and stitched at high speed along its edge 5 to form the first seam S1.

8. When the trailing edge of the collar, which is its edge 3, travels out from under the button 141 of the slow-down sensor 121, the rod 139 of sensor 121 drops and valve member 137 of sensor 121 engages its valve seat 135 to increase the pressure of air delivered through the outlet 133 of this sensor via line 405 to the pilot of valve V26. This actuates valve V26 to deliver air via line 413 to the pilot of valve V30, which thereupon cuts off the supply of air via line 429 to port a of cylinder C11 and vents this port back through line 429. With port a of cylinder C11 vented, port b of cylinder C11 remaining vented from step 6, and port a of cylinder C12 supplied with air and port b of cylinder C12 vented from step 6, cylinder C12 is pulled down to its lower limit, thereby pulling down cylinder C11, and rod 317 is moved down by the spring means in unit 53 to the slow-speed position for driving the sewing machine 29 at the low speed (e.g., 400 stitches per minute).

9. The collar W continues to be fed forward through the sewing machine for being stitched along the edge 5, but at low speed ( e.g., 400 stitches per minute), to complete the seam S1.

10. When the trailing edge 3 of the collar travels out from under the button 141 of the stop sensor 123 (see FIG. 4), the rod 139 of sensor 123 drops and valve member 137 of sensor 123 engages its valve seat 135 to increase the pressure of air delivered through the outlet 133 of this sensor via line 403 to the pilot of valve V25. This actuates valve V25 to deliver air via line 411 to the pilot of valve V29, which thereupon cuts off the supply of air to the system of lines 425 and vents this system. Upon venting the system 425:

a. Port a of cylinder C12 is vented.

b. The pilot of valve V18 is vented and this valve opens, thereby venting the pilot of valve V19 via line 363, line 361, and port a of valve V15 which at this time is set for venting this to atmosphere. With the pilot of valve V19 vented, the supply of air through V19 is cut off, and ports b of cylinders C11 and C12 are vented via lines 367 and 365 back through valve V19.

c. The pilot of valve V31 is vented so that valve V31 opens to supply air to the left-hand pilot of valve V6. This sets valve V6 for delivery of air through its port b, and venting of air via its port a.

11. With ports a and b of cylinders C11 and C12 all vented, the rod 317 is brought to its neutral position by the spring means in unit 53 for stopping the sewing machine 29 with the needle N down in the collar at point 17 at the end of the seam S1 (see FIG. 4).

12. As a result of step 10c, air is supplied from port b of valve V6 via line 322 to the rear ends of cylinders C1 and C4 and vented from the forward end of cylinder C4 via line 321 and port a of valve V6, thereby raising the sensors 121 and 123 and the presser foot 37.

13. Further as a result of step 10c, air is supplied from port b of valve V6 via line 325 to the inlet of valve V17, and also supplied to the left-hand pilot of valve V12. This sets valve V12 for delivery of air through its port b via line 386 to the inlet of valve V11.

14. Valve V17, being deactuated and thus open, delivers air from line 325 to the right-hand pilot of valve V8, which sets valve V8 to supply air via its port a and line 335 to the forward end of cylinder C2 and to vent the rear end of this cylinder via line 337 and its port b, with the result that the guide bar 63 is retracted to its solid-line position of FIG. 12 and its position of FIGS. 11 and 15.

15. Valve V12 (piloted on the left in step 13) supplies air from its b port via line 386 to the inlet of valve V11. The latter, having been piloted on its left in step 1c, delivers the air via its b port and line 381 to the pilot of time-delay valve V21. After its delay, valve V21 opens to deliver air via line 383 to the pilot of valve V22, thereby opening the latter for delivery of air via line 97 to the hub 95 of the air blowing means 89, and also for delivery of air via line 385 to the left-hand pilot of valve V7. This cuts off delivery of air via port a of valve V7.

16. Air supplied to the hub 95 of the air blowing means 89 is delivered through the tubular arms 93 to the jets 91 and out through the jets to blow the collar around from its FIG. 4 position (which is the S1 seam-ending position) to its FIG. 5 position (which is the starting position for seam S2) determined by engagement of the edge 3 of the collar with the stop 209 (the first stop). The collar swings around from the FIG. 4 to the FIG. 5 position about the needle N as a pivot, the needle being down in the collar. As the collar approaches the FIG. 5 S2 seam starting position, its edge 3 engages the trip wire 213 of valve V2 and actuates this valve.

17. Upon actuation of valve V2, the supply of air via line 401 to the pilot of valve V24 is cut off. Valve V24 closes, cutting off pilot air to valve V28, and valve V28 opens to deliver air to line 423.

18. Air is supplied via 423 to the shuttle 417 and thence to the right-hand pilot of valve V12. This cuts off delivery of air from port b of valve V12 and vents it to deactuate valves V21 and V22 and stop the blowing of air.

19. Air is also supplied via 423 to the right-hand pilot of valve V9, actuating this valve for delivery of air via its a port and line 343 to the rear end of cylinder C6 to lower the stop arm 221 to bring the stop 229 (the second stop) down to the table 25 (see FIG. 18).

20. Air is also supplied via 423 and shuttles 419 and 421 to the right-hand pilot of valve V6, as a result of which air is delivered through port a of valve V6 and via line 321 to the forward end of cylinder C4 and vented from the rear end of this cylinder and from the rear end of cylinder C1 via line 322 and port b of the valve to lower the sensors 121 and 123 and the presser foot 37 into engagement with the collar. When the sensors are lowered, their chambers 129 and vented as in step 2.

21. As a result of chambers 129 of sensors 121 and 123 being vented in step 20, the sewing machine 29 is driven at high speed as in step 6.

22. The collar is fed forward through the sewing machine from the FIG. 5 position and stitched at high speed along its edge 3 (see FIGS. 5 and 6) to form the second seam S2.

23. When the trailing edge 7 of the collar travels out from under the button 141 of the slow-down sensor 121, the sewing machine is slowed down as in step 8.

24. The collar continues to be fed through the sewing machine for being stitched along the edge 3, but at low speed, to complete the seam S2.

25. When the trailing edge 7 of the collar travels out from under the button 141 of the stop sensor 123, step 10 is repeated.

26. The sewing machine stops as in step 11 with the needle N down in the collar at point 19 at the end of seam S2 (see FIG. 6).

27. The sensors 121 and 123 and the presser foot 37 are raised as in step 12.

28. Step 13 is repeated.

29. Bar 63 remains retracted from step 14.

30. Step 15 is repeated.

31. Air blows out through the jets (as in step 16) to blow the collar around from the FIG. 6 position (where seam S2 ended) to the FIG. 7 position for starting seam S3, determined by engagement of the edge 1 of of the collar with the stop 229 (which came down in step 19). The collar swings around the needle as a pivot, the needle being down in the collar. As the collar approaches the FIG. 7 position, its edge 1 engages the trip wire 239 of valve V3 and actuates this valve.

32. Upon actuation of valve V3, the supply of air via line 399 to the pilot of valve V23 is cut off. Valve V23 closes, cutting off pilot air to valve V27, and valve V27 opens to deliver air to line 415.

33. Line 415 supplies air:

a. Via shuttles 419 and 421 to the right-hand pilot of valve V6.

b. To the right-hand pilot of valve V7.

c. To the right-hand pilot of valve V10.

d. To the right-hand pilot of valve V11.

e. To the left-hand pilot of valve V9.

f. Via shuttle 417, to the right-hand pilot of valve V12.

g. To the right-hand pilot of valve V13.

34. As a result of step 33a, the sensors 121 and 123 are lowered, as in step 20, and their chambers 129 are vented, as in step 2, and the presser foot 37 is lowered, as in step 3. 35. As a result of step 33b, air is delivered from port a of valve V7 via line 333 to the left-hand pilot of valve V8, which sets valve V8 to deliver air from its port b via line 337 to the rear end of cylinder C2 and to vent air from the forward end of this cylinder via line 335 and port a of valve V8, thereby extending the piston rod 83 of cylinder C2 and returning the guide bar 63 to its extended work guiding position (shown in phantom in FIG. 12) for guiding the collar for sewing seam S3.

36. As a result of step 33c, air is delivered from port a of valve V10 via line 339 to the forward end of cylinder C3 and vented from the rear end of this cylinder via line 341 and port b of valve V10. The piston rod 111 of cylinder C3 is thereupon retracted to swing the air blowing means 89 up to the raised retracted position in which it is shown in phantom in FIG. 16. Pin 117 on arm 101 thereupon actuates valve V1.

37. As a result of steps 33d and f, air is vented from the pilot of valve V21 via line 381, port b of valve V11, line 386 and port b of valve V12, thereby deactuating and closing valve V22 to cut off the delivery of air to the air blowing means 89, as in step 18.

38. As a result of step 33e, the rear end of cylinder C6 is vented via line 343 and port a of valve V9, and the spring for cylinder C6 raises the arm 221 to retract the second stop 229.

39. As a result of step 33g, air is delivered from port a of valve V13 via line 319 to the forward end of cylinder C5 and vented from the rear end of this cylinder via line 320 and port b of valve V13, thereby retracting the piston rod of cylinder C5 and moving the sensors 121 and 123 from their downstream position (where they sensed the slow-down and seam ending positions for seams S1 and S2) to their upstream position (shown in FIGS. 7 and 8 and in phantom lines in FIG. 10) for sensing the slow-down and seam ending positions for seam S3.

40. When the chambers 129 of sensors 121 and 123 are vented as a result of step 34, the sewing machine 29 is driven at high speed as in step 6 (and step 21) for sewing seam S3.

41. The collar is fed forward through the sewing machine from the FIG. 7 position and stitched at high speed along its edge 7 to form the third seam S3.

42. When the trailing edge 1 of the collar travels out from under the button 141 of the slow-down sensor 121, the sewing machine is slowed down as in steps 8 and 23.

43. The collar continues to be fed through the sewing machine for being stitched along the edge 7, but at low speed, to complete the seam S3.

44. When the trailing edge 7 of the collar travels out from under the button 141 of the stop sensor 123, valve V29 is closed as in step 10 so as to vent the system of lines 425, thus repeating step 10.

45. As a result of valve V1 having been actuated by pin 117 on the upward swing of arm 101 to raise the air blowing means 89 (refer back to step 36), and remaining actuated as long as arm 101 is raised, air is supplied from port a of valve V10 (refer back to step 36) via line 431 including valve V1 to the left-hand pilot of valve V16. Air is then supplied from port b of valve V16 via line 329 to the rear end of cylinder C9 and to the pilot of valve V17, and via line 355 to the right-hand pilot of valve V15. Air is then supplied via line 361 from port a of valve V15 to the inlet of valve V18. With the pilot of valve V18 being vented at this time via 425 and valve V29 (which is deactuated), air is supplied through valve V18 via line 363 to the pilot of valve V19. The latter thereupon opens and supplies air via lines 365, 367, 369 and 370 to ports b of cylinders C11 and C12, and via lines 365 and 373 to the pilot of time-delay valve V20.

46. With ports b of cylinders C11 and C12 supplied with air, port a of cylinder C11 vented via line 429 and valve V30, and port a of cylinder C12 vented via 425 and valve V29, cylinder C12 is raised to raise cylinder C11 and rod 317 is raised relative to cylinder C11 to stop the sewing machine 29 with the needle N up and to operate the thread trimmer 55, thus ending the sewing of seam S3 at point 21 as illustrated in FIG. 8 and cutting the thread in preparation for stitching the next collar.

47. Upon delivery of pilot air to the left-hand pilot of valve V6 (step 44, repeating step 10), valve V6 effects raising of the sensors 121 and 123 and the presser foot 37 as in step 12, for removal of the completed collar and insertion of the next collar to be topstitched.

48. Air is delivered from line 367 via line 371 to the left-hand pilot of valve V13, resulting in delivery of air from port b of valve V13 via line 320 to the rear end of cylinder C5 and venting of the forward end of this cylinder via line 319 and port a of cylinder V13. This effects retraction of the piston rod 193 of cylinder C5 to move the sensors 121 and 123 back to their downstream position of FIGS. 3–6, 10 and 15.

49. Upon actuation of the left-hand pilot of valve V16 (step 45), air is supplied from port b of valve V16 via lines 331, 329 and 351 to the rear end of cylinder C9 and vented from the forward end of this cylinder and from the rear end of cylinder C10 via lines 347 and 345 and port a of valve V16. The piston rod 299 of cylinder C9 is thereby extended to swing the unloader lever 291 from its retracted position of FIG. 1 to its collar-engaging position of FIG. 8, and the piston rod 311 of cylinder C10 is driven up by the spring in this cylinder for retraction of the gripper 283. The lever 291 swings in under the raised air blowing means 89.

50. Upon elapse of its time delay, valve V20 (actuated in step 45) supplies air via line 377 to the right-hand pilot of valve V16. Air is thereupon supplied from port a of valve V16 via lines 345 and 347 to the forward end of cylinder C9 and vented from its rear end via line 351, line 329 and port b of valve V16. Air is also supplied from line 347 via line 349 to the rear (upper) end of cylinder C10 to drive down the piston rod 311 of this cylinder and thereby drive the unloader gripper 283 down into gripping engagement with the collar. With the gripper down and gripping the collar, lever 291 is retracted to its FIG. 1 position via retraction of piston rod 299 of cylinder C9. The gripper 283, moving from the FIG. 8 to the FIG. 1 position, slides the collar over the table top 25 and off the edge 287 of the table top, the collar falling into the receiver 249.

51. On retraction of the unloader lever 291, valve V5 is actuated, resulting in air being supplied from port a of valve V16 via line 439 through valve V5 to the left-hand pilot of valve V10. Air is thereupon supplied from port b of valve V10 via line 341 to the rear end of cylinder C3 and vented from the forward end of this cylinder via line 339 and port a of valve V10 to extend piston rod 111 of cylinder C3 and lower the air blowing means 89.

52. At any convenient time while the first collar is being stitched, the next collar to be stitched is placed on the extension 250 of the table top in the W1 position, as facilitated by the provision of low-profile adjustable gauges 453 and 455 and a mark 457 on the table top extension 250 (see FIG. 1). Upon such placement of the collar at W1, trip wire 445 of valve V34 is actuated, which results in deactuation of valve V32, permitting flow of air from line 353 through line 441 to the left-hand pilot of valve V14.

53. Air supplied from port a of valve V16 to lines 345 and 347 in step 50 is delivered via line 353 to the left-hand pilot of valve V15 and via line 441 through valve V32 to the left-hand pilot of V14. This results in air being supplied from port b of valve V14 via line 359 to the forward end of cylinder C7 and the rearward end of cylinder C8, and venting of air from the rear end of cylinder C7 via line 357 and port a of valve V14. The gripper 251 is thereupon moved downward against the action of the spring in cylinder C8 to grip the collar at the W1 position, and the piston rod 267 of cylinder C7 is retracted to swing the loader lever 259 forward from its FIG. 1 to its FIG. 3 position, thereby sliding the collar over the table top from the W1 position to the W2 position of FIG. 3 for starting the sewing of seam S1 on the collar. As the collar moves away from the W1 position, the collar releases the trip wire 445 of valve V34. The latter is thereby deactuated. This cuts off pilot air to valve V33, which in turn cuts off pilot air to valve V32, causing valve V32 to close against flow of air from line 353 via line 441 to the left-hand actuator of valve V14 and to vent the latter.

54. As the entry of the collar in the sewing machine is completed (i.e., as the collar reaches the W2 position), lever 259 engages and actuates the valve V4 (see FIG. 3), and valve V4 thereupon supplies air via line 435 as in step 1.

55. Line 435 supplies air to the right-hand pilot of valve V14, as in step 1b, resulting in delivery of air from port a of valve V14 via line 357 to the rear end of cylinder C7 and venting of air from the forward end of this cylinder via line 359 and port b of valve V14 to extend the piston rod 267 of this cylinder. Air is also vented from the rear (upper) end of cylinder C8 via line 359 so that the gripper 251 is raised to its retracted position by the spring in cylinder C7 (see FIG. 21). With the gripper 251 raised, lever 259 swings back to its FIG. 1 retracted position.

Figure 5:
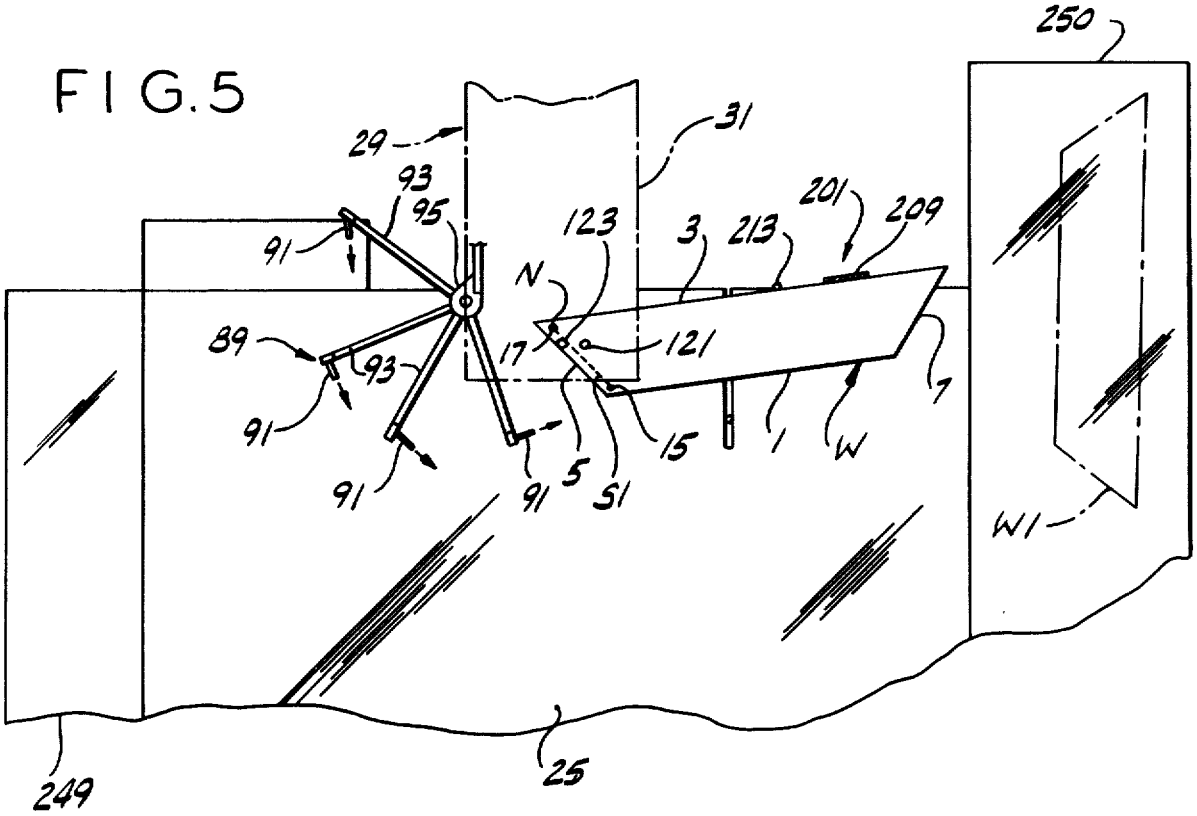
FIG. 5 is a partial plan showing the collar swung around the needle of the sewing machine as a pivot to start the stitching of a seam along the lower edge of the collar.

In response to actuation of valve V4, steps 2–4 and 6–50 are repeated for automatically sewing seam S1 on the second collar (FIGS. 3–4) turning it to the FIG. 5 position, sewing seam S2 (FIGS. 5–6), turning it to the FIG. 7 position, sewing seam S3 (FIGS. 7 and 8), and unloading the completed collar.

While the second collar is being sewn, a third collar (the next collar) is placed in the W1 position, and when valve V5 is actuated on retraction of the unloader 247 (step 50) to unload the completed second collar, steps 51, 53 and 54 are repeated for entry of the third collar in the sewing machine, and the accompanying actuation of valve V4 (step 54), thereby repeating the operation for the third collar.

During the operation of topstitching each collar, the next collar to be topstitched is placed in the W1 position for being entered in the sewing machine (i.e., moved to the W2 position by the loader 245) on completion of the unloading of the preceding collar, and thus the entire series of collars is topstitched with the operation being entirely automatic except for the placement of collars at the W1 position for loading. This may also be suitably automated, if so desired.

When the last collar of the series has been moved from the W1 to the W2 position for being stitched, valve V34 remains deactuated, so that it supplies air to the pilot of valve V33. The latter thus supplies air to the pilot of valve V32, causing the latter to close and cut off the supply of air to the left-hand pilot of valve V14, with the result that when lever 259 of the loader 245 returns to its retracted position of FIG. 1, it remains there with the gripper 251 up. Thus, the apparatus stops with the sewing machine 29 off and the needle N up (step 46), the presser foot 37 up (step 47), the guide bar 63 in its extended position (step 35), the air blowing means 89 down (step 51), the sensors 121 and 123 raised (step 47) and in their downstream position (step 48), stop 229 up (step 38), the loader 245 retracted (as a result of valve V34 being deactuated), the unloader 247 retracted (step 50), in readiness for operation on the next series of collars.

While the apparatus as shown and described herein has a pneumatic control system for the cylinders C1–12, it is contemplated that an electric control system (employing solenoid-operated valves, for example) may be used within the scope of the invention. In the electrical control system, electrical sensors would be used in place of the pneumatic sensors 121 and 123, and switches would be used instead of valves V1–V5 and V34, for example.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for automatically sewing workpieces along edges of each workpiece extending in different directions comprising:

a sewing machine having means for feeding a workpiece therethrough for being stitched and a needle for stitching a seam along an edge of the workpiece as it is fed through the sewing machine;

means for controlling the sewing machine operable to start it and operable to stop it with the needle down in a workpiece for utilization of the needle as a pivot for turning the workpiece;

means for guiding a workpiece through the sewing machine for stitching a seam along an edge of the workpiece;

means operable with the needle down in a workpiece for blowing air on the workpiece in such direction as to turn the workpiece by blowing it around the needle as a pivot;

means operable as a workpiece is being fed through the sewing machine and stitched along one edge thereof for sensing when the workpiece reaches a seam-ending position for terminating the stitching along said one edge;

means controlled by said sensing means operable when said sensing means senses the workpiece reaching said seam-ending position for operating said sewing machine control means to stop the sewing machine with the workpiece in said seam-ending position and with the needle down in the workpiece, and then operating the blowing means to blow air on the workpiece for blowing it around;

stop means engageable by an edge of the workpiece as the workpiece is being blown around to stop the workpiece in a seam-starting position for stitching a seam along the next edge; and means operable by the workpiece as it reaches said seam-starting position for controlling said sewing machine control means to start the sewing machine for stitching along said next edge.

2. Apparatus as set forth in claim 1 comprising a table over which the workpiece may slide and wherein the blowing means comprises a series of air jets arranged at intervals for blowing it around on the the table.

3. Apparatus as set forth in claim 1 wherein the stop means comprises a first stop engageable by an edge of the workpiece as it is blown around a first time after the sewing of a first seam, and a second stop engageable by another edge of the workpiece as it is blown around a second time after the sewing of a second seam, the second stop being movable from a retracted position clear of a workpiece as it is blown around the first time to an operative position for engagement by the workpiece when it is blown around the second time.

4. Apparatus as set forth in claim 1 wherein said sensing means is movable to different positions for sensing the seam-ending position for different edges of a workpiece.

5. Apparatus as set forth in claim 4 having means for automatically moving the sensing means from a position for sensing the seam-ending position for one edge of a workpiece to a position for sensing the seam-ending position of another edge of the workpiece when said one edge has been stitched.

6. Apparatus as set forth in claim 1 having means for controlling the speed of the sewing machine operable for driving the machine at a relatively high speed or a relatively low speed, and wherein the sensing means comprises a first sensor for sensing when the workpiece reaches a slow-down position for operating said speed control to change from the high to the low speed, and a second sensor for sensing when the workpiece reaches the seam-ending position to stop the sewing machine and operate the blowing means.

7. Apparatus as set forth in claim 6 wherein the first and second sensors are movable to different positions for sensing the seam-ending position for different edges of a workpiece.

8. Apparatus as set forth in claim 7 having means for automatically moving the first and second sensors from a position for sensing the seam-ending position for one edge of a workpiece to a position for sensing the seam-ending position of another edge of the workpiece when said one edge has been stitched.

9. Apparatus as set forth in claim 1 wherein the sewing machine has a presser foot and means for raising and lowering the presser foot, the presser foot being raised when the sewing machine stops so that the workpiece may be blown around the needle as a pivot.

10. Apparatus as set forth in claim 9 wherein the means for guiding the workpiece comprises a guide engageable by the edge of the workpiece being stitched.

11. Apparatus as set forth in claim 10 wherein the means for guiding the workpiece further comprises guide extension means having a straight edge movable between an operative position wherein said edge is aligned with the guide for engagement by a straight edge of the workpiece being stitched, to guide the workpiece through the sewing machine for stitching a seam along said straight edge of the workpiece, and a retracted position for stitching along a curved edge of the workpiece.

12. Apparatus as set forth in claim 11 having means for retracting said extension means on turning a workpiece for stitching along a curved edge of the workpiece.

13. Apparatus as set forth in claim 12 wherein the guide is movable between an operative position wherein it is engageable by a workpiece and a retracted position.

14. Apparatus as set forth in claim 13 wherein the guide is on the presser foot and is raised with the presser foot to its retracted position.

15. Apparatus as set forth in claim 1 wherein the means controlled by the sewing machine is operable to stop the sewing machine with the needle up, and wherein the means controlled by the sensing means is operable when the sensing means senses the workpiece reaching the seam-ending position for each seam before the last seam for stopping the sewing machine with the needle down and then operating the blowing means to blow the workpiece around for sewing the next seam, and is operable when the sensing means senses the workpiece reaching the seam-ending position for the last seam for stopping the sewing machine with the needle up.

16. Apparatus as set forth in claim 15 further having means for trimming the thread when the sewing machine stops with the needle up after having sewn the last seam of a workpiece, means for unloading the completed workpiece, and means for loading the next workpiece to be sewn into the sewing machine.

17. Apparatus as set forth in claim 16 comprising a table over which a workpiece may slide and wherein the loading means comprises means for sliding a workpiece over the table toward the sewing machine and entering it in the sewing machine in a position for starting the sewing of a first seam, and the unloading means comprises means for sliding a completed workpiece away from the sewing machine over the table.

18. Apparatus as set forth in claim 17 wherein the sensing means comprises feeler means engageable with a workpiece as the workpiece is fed through the sewing machine, and means for moving the sensing means to a retracted position wherein the feeler means is clear of the path of entry of a workpiece in the sewing machine enabling entry of the next workpiece in the sewing machine when the sewing machine stops with the needle up on completing the sewing of a workpiece.

19. Apparatus as set forth in claim 18 wherein the sewing machine has a presser foot and means for raising and lowering the presser foot, the presser foot being raised when the sewing machine stops with the needle down for the blowing of the workpiece around the needle as a pivot and also when the sewing machine stops with the needle up for the removal of the completed workpiece and the entry of the next workpiece.

20. Apparatus as set forth in claim 19 wherein the blowing means comprises a series of air jets arranged at intervals for blowing it around on the table.

21. Apparatus as set forth in claim 20 wherein the air jets are movable to a retracted position clear of the unloading means for operation of the latter.

22. Apparatus as set forth in claim 16 wherein the stop means comprises a first stop engageable by an edge of the workpiece as it is blown around a first time after the sewing of a first seam, and a second stop engageable by another edge of the workpiece as it is blown around a second time after the sewing of a second seam, one of the stops being movable between a retracted position clear of a workpiece as it is being blown around and an operative position for engagement by the workpiece when it is blown around the second time.

23. Apparatus as set forth in claim 22 wherein the second stop is movable from a retracted position clear of a workpiece as it is being blown around the first time to an operative position for engagement by the workpiece when it is blown around the second time.

24. Apparatus as set forth in claim 1, wherein the sensing means comprises a pneumatic sensor, said sensor comprising a valve having an air chamber, an air inlet for flow of air to the chamber, an air outlet for flow of air from the chamber, and a vent for venting air from the chamber, a valve member for closing the vent, a feeler controlling the valve member, said feeler being engageable with a workpiece as the workpiece is fed through the sewing machine to hold the valve member in an open position and movable when the workpiece travels out from under the feeler to a position for closing of the valve member, air being vented from the chamber via the vent when the valve member is open to reduce the pressure of air flowing through the outlet, air being held in the chamber when the valve member is closed to increase the pressure of air flowing through the outlet as a signal that the valve member has moved.

25. Apparatus as set forth in claim 6 wherein each sensor is a pneumatic sensor comprising a valve having an air chamber, an air inlet for flow of air to the chamber, an air outlet for flow of air from the chamber, and a vent for venting air from the chamber, a valve member for closing the vent, a feeler controlling the valve member, said feeler being engageable with a workpiece as the workpiece is fed through the sewing machine to hold the valve member in an open position and movable when the workpiece travels out from under the feeler to a position for closing of the valve member, air being vented from the chamber via the vent when the valve member is open to reduce the pressure of air flowing through the outlet, air being held in the chamber when the valve member is closed to increase the pressure of air flowing through the outlet as a signal that the valve member has moved.

26. Apparatus for automatically sewing workpieces along edges of each workpiece extending in different directions comprising:

a sewing machine having means for feeding a workpiece therethrough for being stitched and a needle for stitching a seam along an edge of the workpiece as it is fed through the sewing machine;

means for controlling the sewing machine operable to start it, operable to stop it with the needle down in a workpiece for utilization of the needle as a pivot for turning the workpiece, and operable to stop it with the needle up;

means for guiding a workpiece through the sewing machine for stitching a seam along an edge of the workpiece;

means operable with the needle down in a workpiece for turning the workpiece around the needle as a pivot;

said turning means further comprising means for blowing air on the workpiece from above the table to turn the workpiece by blowing it around on the table and around the needle as a pivot;

means operable as a workpiece is being fed through the sewing machine and stitched along one edge thereof for sensing when the workpiece reaches a seam-ending position for terminating the stitching along said one edge;

means controlled by said sensing means operable when said sensing means senses the workpiece reaching said seam-ending position for each seam before the last seam for operating said sewing machine control means to stop the sewing machine with the workpiece in said seam-ending position and with the needle down in the workpiece, and then operating said turning means for turning the workpiece to a seam-starting position for stitching a seam along the next edge and operable when the sensing means senses the workpiece reaching the seam-ending position for the last seam for stopping the sewing machine with the needle up;

means operable by the workpiece as it reaches said seam-starting position for controlling said sewing machine control means to start the sewing machine for stitching along said next edge;

a table over which a workpiece may slide and wherein the loading means comprises means for sliding a workpiece over the table toward the sewing machine and entering it in the sewing machine in a position for starting the sewing of a first seam, and the unloading means comprises means for sliding a completed workpiece away from the sewing machine over the table after the sewing of the last seam; means for trimming the thread when the sewing machine stops with the needle up after having sewn the last seam of a workpiece, enabling the unloading of the completed workpiece, and the loading of the next workpiece to be sewn into the sewing machine;

means for unloading the completed workpiece; and means for loading the next workpiece to be sewn into the sewing machine.

27. Apparatus as set forth in claim 26 wherein the stop means comprises a first stop engageable by an edge of the workpiece as it is blown around on the table a first time after the sewing of a first seam, and a second stop engageable by another edge of the workpiece as it is blown around a second time after the sewing of a second seam, the second stop being movable from a retracted position relative to the top surface of the table clear of a workpiece as it is blown around the first time to an operative position in the path of the workpiece when it is blown around on the table the second time.

28. Apparatus as set forth in claim 27 wherein the second stop when in retracted position is above the table and is movable down from its said retracted position to engage the table in its operative position.

29. Apparatus for automatically sewing workpieces along edges of each workpiece extending in different directions comprising:

a sewing machine having means for feeding a workpiece therethrough for being stitched and a needle for stitching a seam along an edge of the workpiece as it is fed through the sewing machine;

loading means for sliding a workpiece over the table and entering it in the sewing machine for starting the sewing of a seam;

means for controlling the sewing machine operable to start and stop it;

means for guiding a workpiece through the sewing machine for stitching a seam along an edge of the workpiece;

means for turning the workpiece in the sewing machine for sewing additional seams;

means operable as a workpiece is being fed through the sewing machine and stitched along one edge thereof for sensing when the workpiece reaches a seam-ending position for terminating the stitching along said one edge;

means controlled by said sensing means operable when said sensing means senses the workpiece reaching said seam-ending position for each seam before the last seam for operating said sewing machine control means to stop the sewing machine with the workpiece in said seam-ending position and then operating said turning means for turning the workpiece to a seam-starting position for stitching a seam along the next edge and operable when the sensing means senses the workpiece reaching the seam-ending position for the last seam for stopping the sewing machine; and means operable by the workpiece as it reaches said seam-starting position for controlling said sewing machine control means to start the sewing machine for stitching along said next edge;

said guiding means comprising a guide engageable by the edge of the workpiece being stitched and guide extension means having a straight edge movable between an operative position wherein said edge is aligned with the guide for engagement by a straight edge of the workpiece being stitched, to guide the workpiece through the sewing machine for stitching a seam along said straight edge of the workpiece, and a retracted position for stitching along a curved edge of the workpiece; and means for retracting said extension means for stitching along a curved edge of a workpiece and/or allowing turning of a workpiece.

* * * * *